United States Patent [19]

Knoblock

[11] Patent Number: 5,050,931

[45] Date of Patent: Sep. 24, 1991

[54] CONTROLLED DEFLECTION FRONT LIP FOR SEATING

[75] Inventor: Glenn A. Knoblock, Kentwood, Mich.

[73] Assignee: Steelcase Inc., Grand Rapids, Mich.

[21] Appl. No.: 850,528

[22] Filed: Apr. 10, 1986

[51] Int. Cl.[5] ..... A47C 1/034

[52] U.S. Cl. ..... 257/311; 297/300; 297/312

[58] Field of Search ..... 297/300–306, 297/311, 312, 458, 459

[56] References Cited

U.S. PATENT DOCUMENTS

| | | | |
|---|---|---|---|
| 354,183 | 12/1886 | Davis . | |
| 416,564 | 12/1889 | Caldwell | 297/300 X |
| 582,144 | 5/1897 | Moore | 297/312 |
| 1,125,801 | 1/1915 | Blood | 297/300 X |
| 3,241,879 | 3/1966 | Castello et al. . | |
| 3,586,375 | 6/1971 | Rathbun . | |
| 3,967,852 | 7/1976 | Eislet et al. . | |
| 4,252,367 | 2/1981 | Vanderminden . | |
| 4,334,709 | 6/1982 | Akiyama et al. | 297/312 X |
| 4,354,709 | 10/1982 | Schuster . | |
| 4,498,702 | 2/1985 | Raftery | 297/312 |
| 4,575,150 | 3/1986 | Smith | 297/300 |
| 4,589,697 | 5/1986 | Bauer et al. | 297/300 |

FOREIGN PATENT DOCUMENTS

| | | | |
|---|---|---|---|
| 800488 | 12/1950 | Fed. Rep. of Germany | 297/458 |
| 2562003 | 10/1985 | France | 297/312 |

*Primary Examiner*—Peter A. Aschenbrenner

*Attorney, Agent, or Firm*—Price, Heneveld, Cooper, DeWitt & Litton

[57] ABSTRACT

A controlled deflection front lip arrangement is provided for seating, such as chairs and the like of the type having a base, and a seat with a rearward portion positioned to contact a buttock area of an adult user, and a forward portion positioned to contact a thigh area of the user. The rearward portion of the seat is attached to the base for support thereon. A spring connects the forward portion of the seat with the base in a manner such that body movement of a seated user deflects the forward portion of the seat upwardly and downwardly independently of the rearward portion of the seat to alleviate undesirable pressure at the thigh area of the user.

30 Claims, 14 Drawing Sheets

FIG. 14
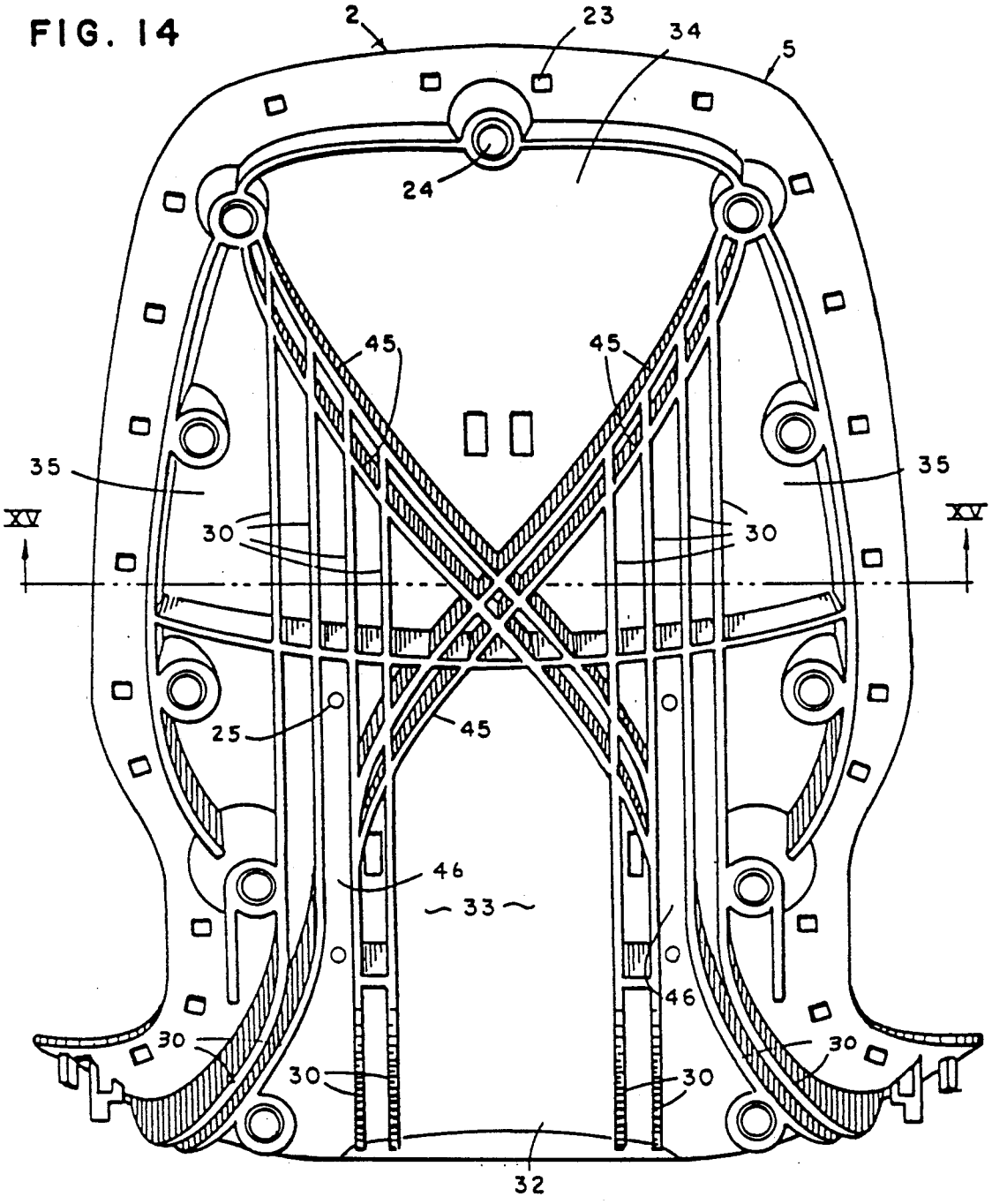
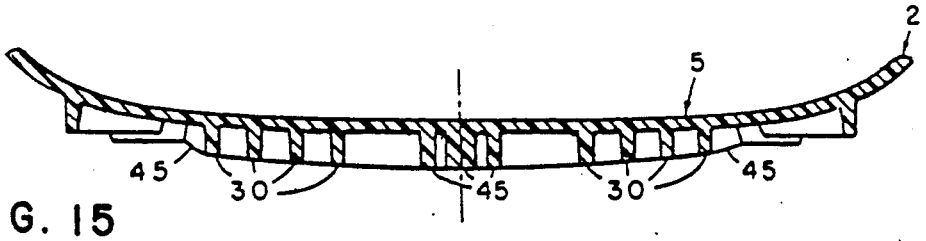
FIG. 15

FIG. 22
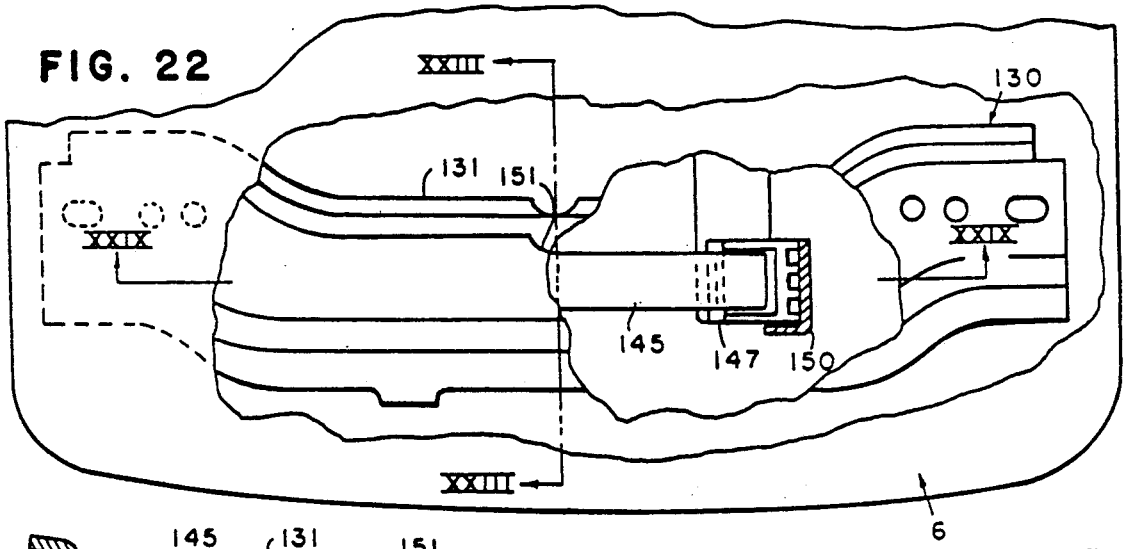
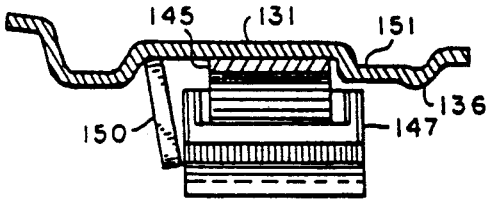
FIG. 23
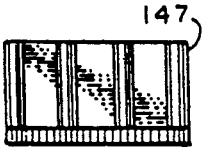
FIG. 24
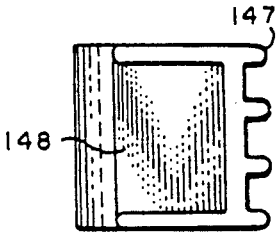
FIG. 25
FIG. 26
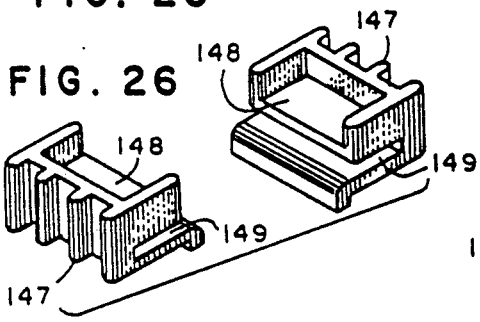
FIG. 27
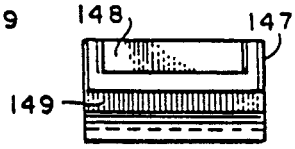
FIG. 28
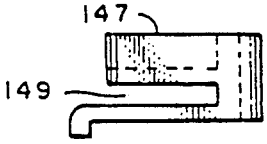
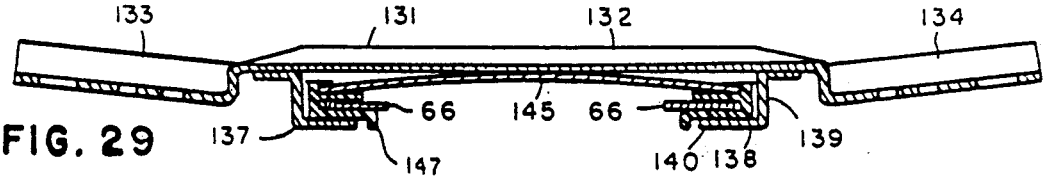
FIG. 29
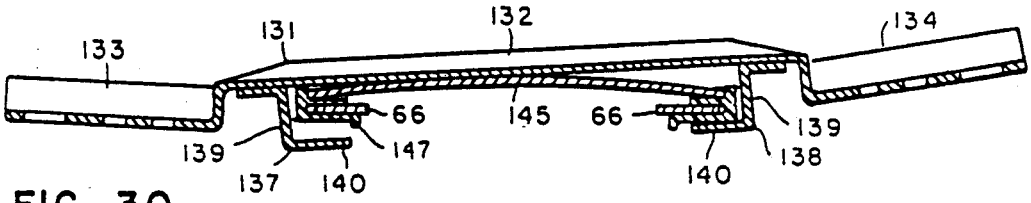
FIG. 30

CONTROLLED DEFLECTION FRONT LIP FOR SEATING

CROSS-REFERENCE TO RELATED APPLICATIONS

The present application is related to co-pending U.S. Pat. application Ser. No. 850,268, filed Apr. 10, 1986, entitled INTEGRATED CHAIR AND CONTROL, which is hereby incorporated by reference.

BACKGROUND OF THE INVENTION

The present invention relates to seating, and in particular to a controlled deflection front lip arrangement therefor.

Some types of seating, such as that disclosed in U.S. Pat. No. 4,498,702 to Raftery, and assigned to the assignee of the present application, have a flexible area at the front lip of the seat to alleviate undesirable pressure on the thighs of the user. However, the flexing action associated with such devise is an uncontrolled, or free type of bending motion, and does not permit the left hand and right hand sides of the seat to deflect independently of one another.

SUMMARY OF THE INVENTION

One aspect of the present invention is a controlled deflection front lip arrangement for seating, such as chairs and the like of the type having a base, and a seat with a rearward portion positioned to contact a buttock area of an adult user, and a forward portion positioned to contact a thigh area of the user. The rearward portion of the seat is operably connected with the base for support thereon. A spring operably connects the forward portion of the seat with the base in a manner such that body movement of a seated user deflects the forward portion of the seat upwardly and downwardly independently of the rearward portion of the seat to alleviate undesirable pressure at the thigh area of the user.

Preferably, the spring comprises an arcuately flexed leaf spring oriented laterally across the forward portion of the seat, which permits the left and right hand sides of the seat to deflect independently of one another, and a stop mechanism is provided to positively limit the upward and downward movement of the seat for a controlled type of deflection.

The principal objects of the present invention are to provide seating whose appearance and performance are attuned to the shape and movement of the user's body, even while performing a variety of tasks. The invention is particularly adapted for seating that has a one-piece, sculptured design which mirrors the human form, and flexes or articulates in a very natural fashion in response to the user's body shape and body movement to optimize both comfort and support in every chair position.

A unique combination of concepts imparts a dynamic or living feeling to the chair, wherein the chair senses the body movement of the user, and deforms and/or moves in reaction thereto to follow the natural movement of the user's body as various tasks and activities are performed, while at the same time, provides improved, highly controlled, postural support.

A controlled deflection front lip arrangement permits the left hand and right hand sides of the seat to flex or move independently of each other, as well as independently of the control. The present invention is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

BRIEF DESCRIPTION OF THE DRAWINGS

FIG. 14 is a rear elevational view of the shell.

FIG. 15 is a horizontal cross-sectional view of the shell, taken a the line XV—XV of FIG. 14.

FIG. 22 is a fragmentary, top plan view of the chair, wherein portions thereof have been broken away to reveal internal construction.

FIG. 23 is an enlarged, fragmentary vertical cross-sectional view of the chair, taken along the line XXIII—XXIII of FIG. 22.

FIG. 24 is an enlarged, rear elevational view of a guide portion of the control.

FIG. 25 is a top plan view of the guide.

FIG. 26 is an enlarged, perspective view of a pair of the guides.

FIG. 27 is an enlarged, front elevational view of the guide.

FIG. 28 is an enlarged, side elevational view of the guide.

FIG. 29 is a vertical cross-sectional view of the chair, taken along the line XXIX—XXIX of FIG. 22.

FIG. 30 is a vertical cross-sectional view of the chair, similar to FIG. 29, wherein the right-hand side of the chair bottom (as viewed by a seated user) has been flexed downwardly.

DETAILED DESCRIPTION OF THE PREFERRED EMBODIMENTS

Figure 1:
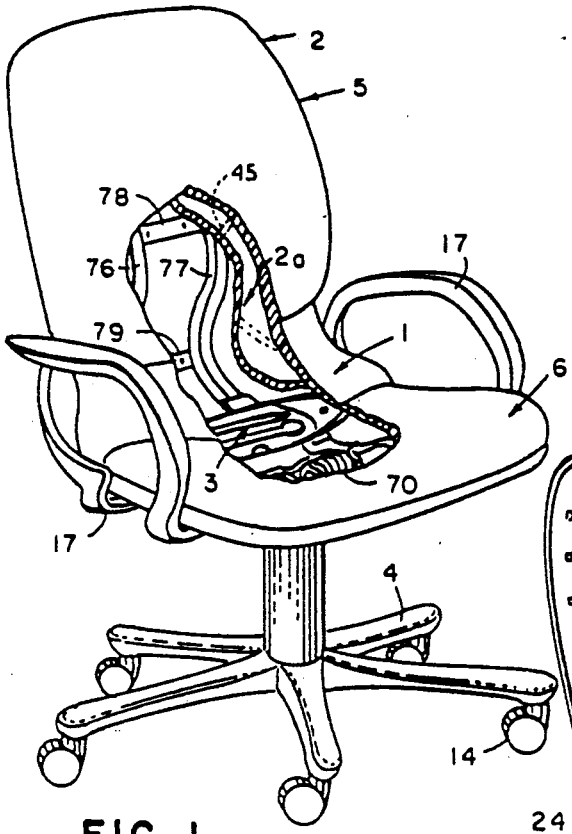
FIG. 1 is a perspective view of a tilt back chair, which includes a controlled deflection front lip arrangement embodying the invention.

For purposes of description herein, the terms "upper,""lower,""right,""left,""rear,""front," "vertical,""horizontal," and derivatives thereof shall relate to the invention as oriented in FIG. 1, and with respect to a seated user. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics relating to the embodiments disclosed herein are not to be considered as limiting, unless the claims by their language expressly state otherwise.

Figure 2:
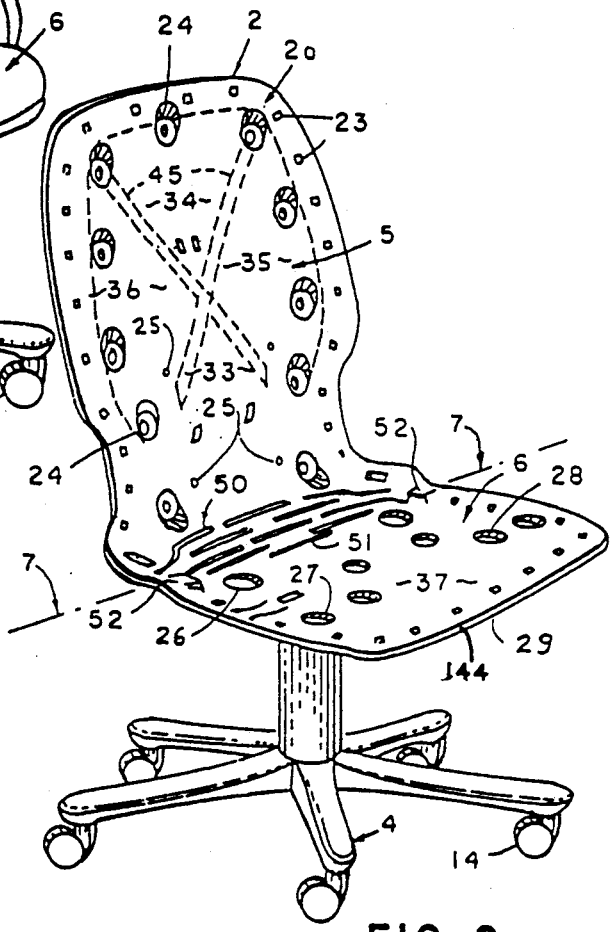
FIG. 2 is a perspective view of the chair, wherein the upholstery has been removed to reveal a shell portion of the present invention.
Figure 6:
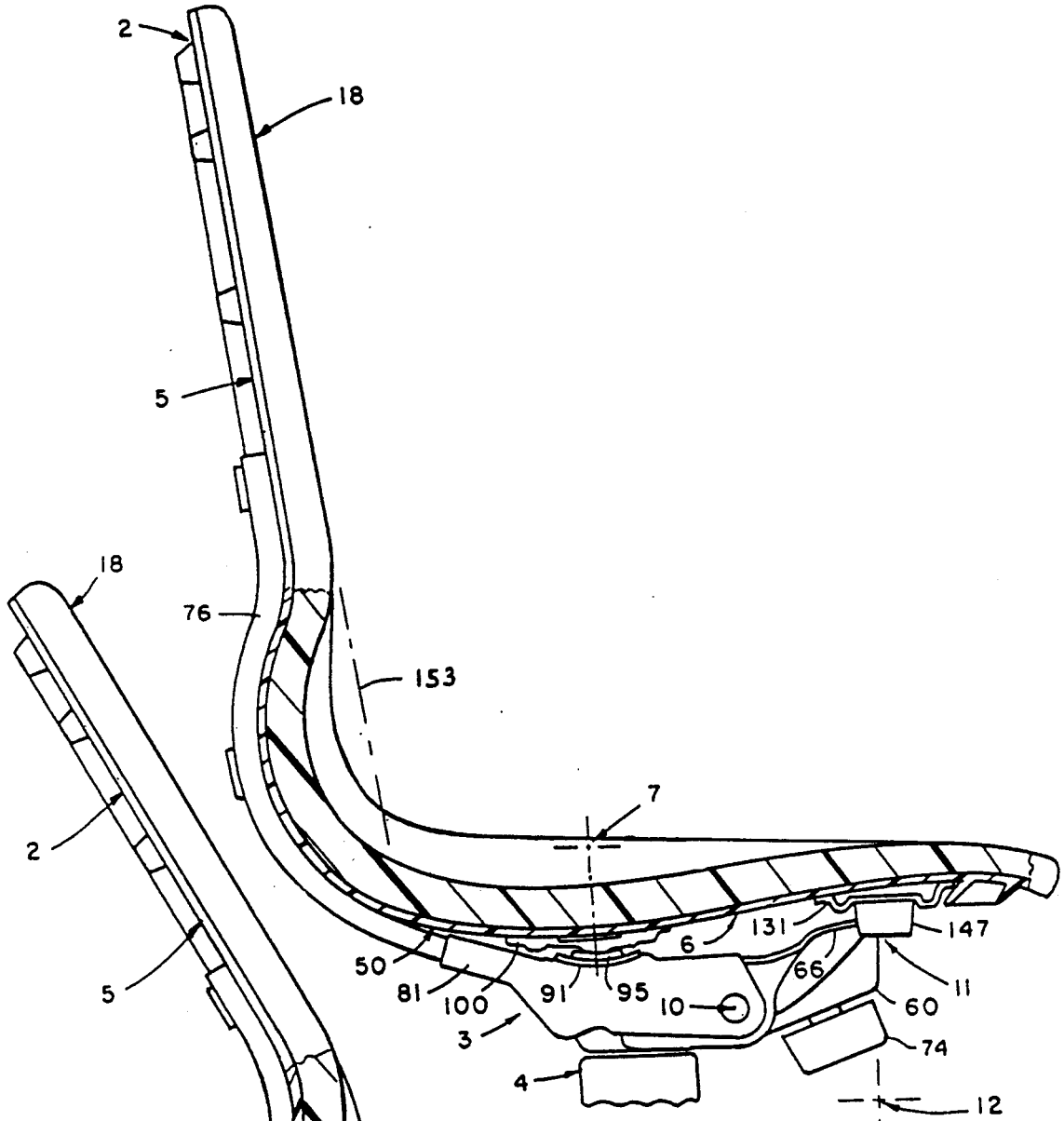
FIG. 6 is a side elevational view of the chair in a partially disassembled condition, shown in a normally upright position.
Figure 7:
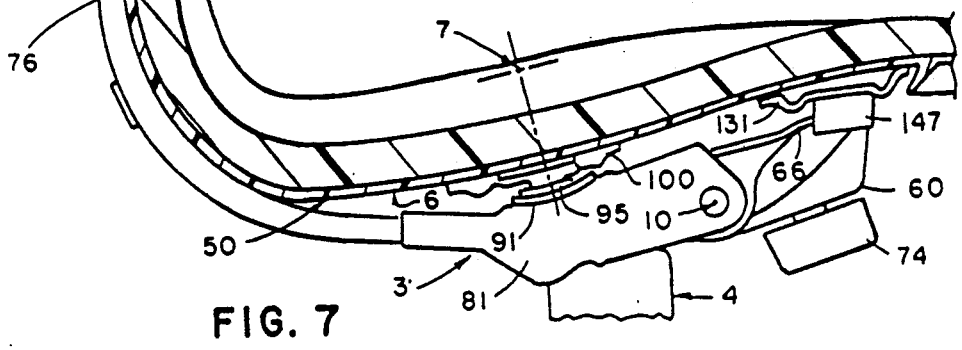
FIG. 7 is a side elevational view of the chair illustrated in FIG. 6, shown in a rearwardly tilted position.
Figure 31:
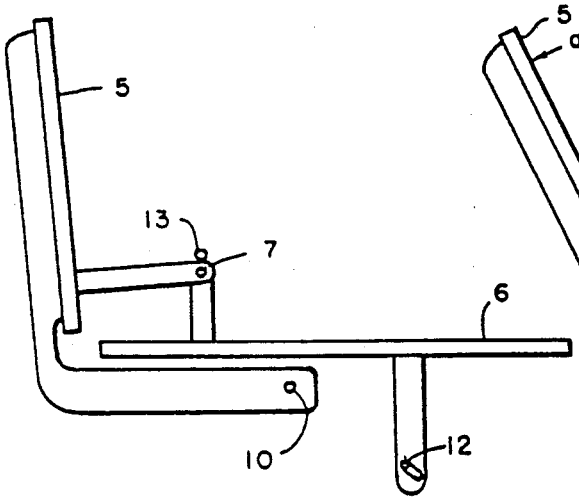
FIG. 31 is a diagrammatic illustration of a kinematic model of the integrated chair and control, with the chair shown in upright position.
Figure 32:
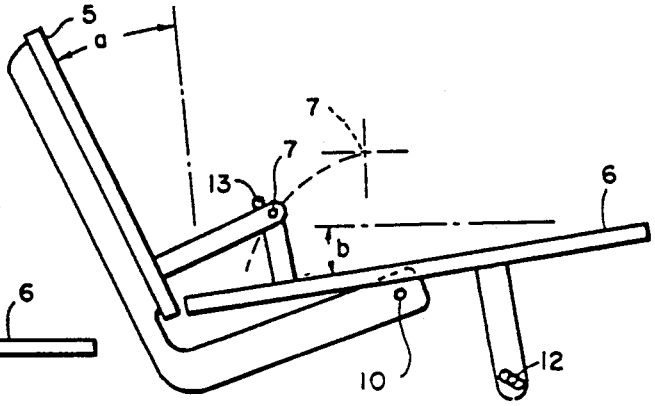
FIG. 32 is a diagrammatic illustration of the kinematic model of the integrated chair and control, with the chair back the rearwardly tilted position.
Figure 34:
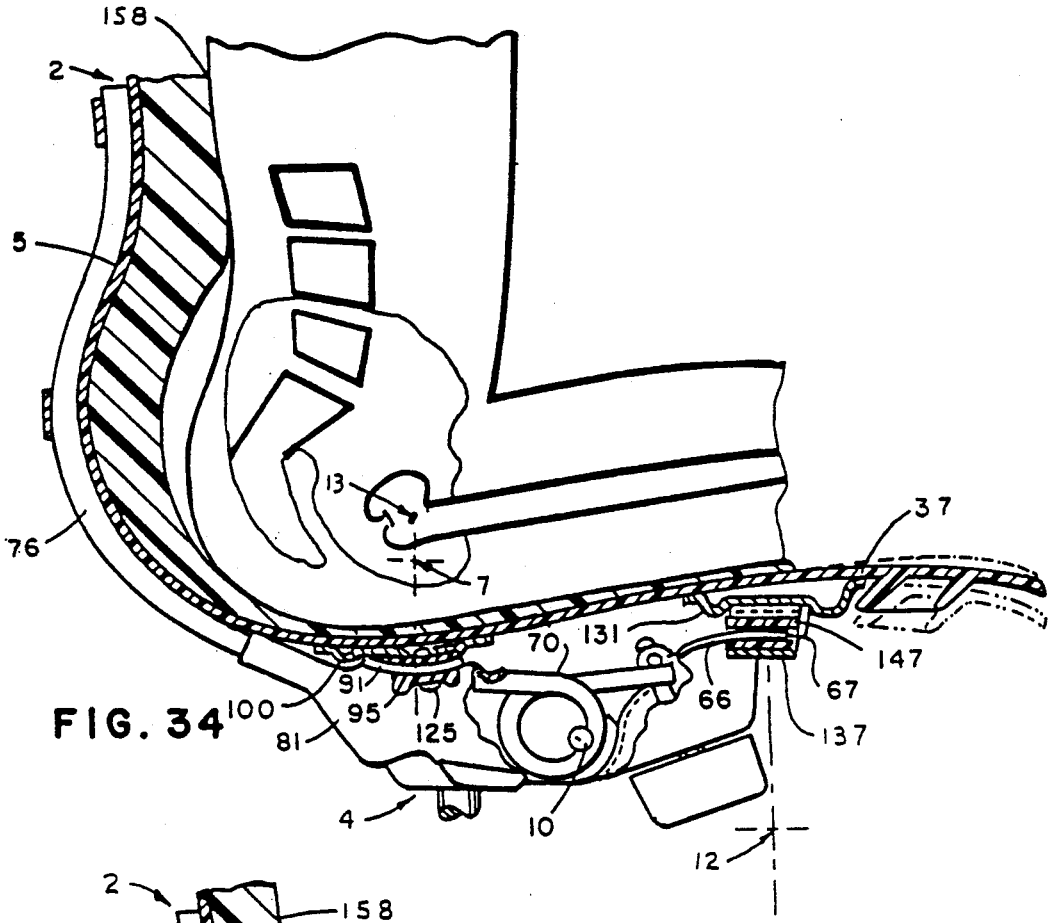
FIG. 34 is a fragmentary, vertical cross-sectional view of the chair, shown in the upright position, and occupied, with a forward portion of the chair bottom moved slightly downwardly.
Figure 35:
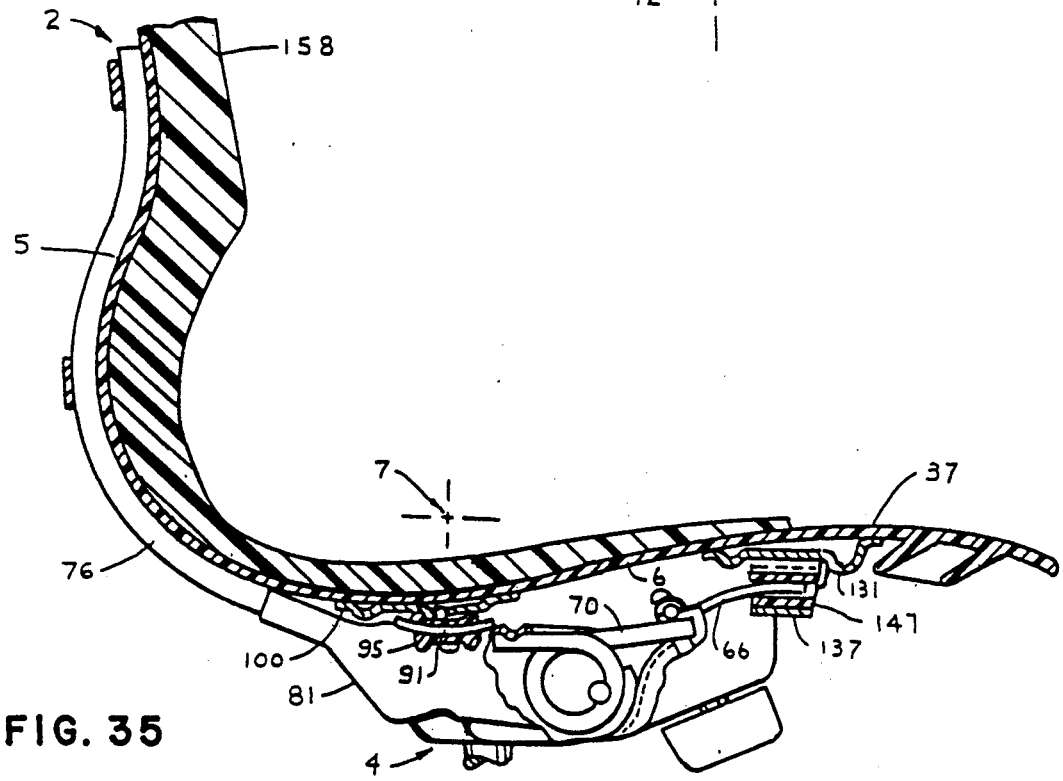
FIG. 35 is a fragmentary, vertical cross-sectional view of the chair, shown in the upright position, and occupied, with the front portion of the chair bottom positioned fully downwardly.
Figure 36:
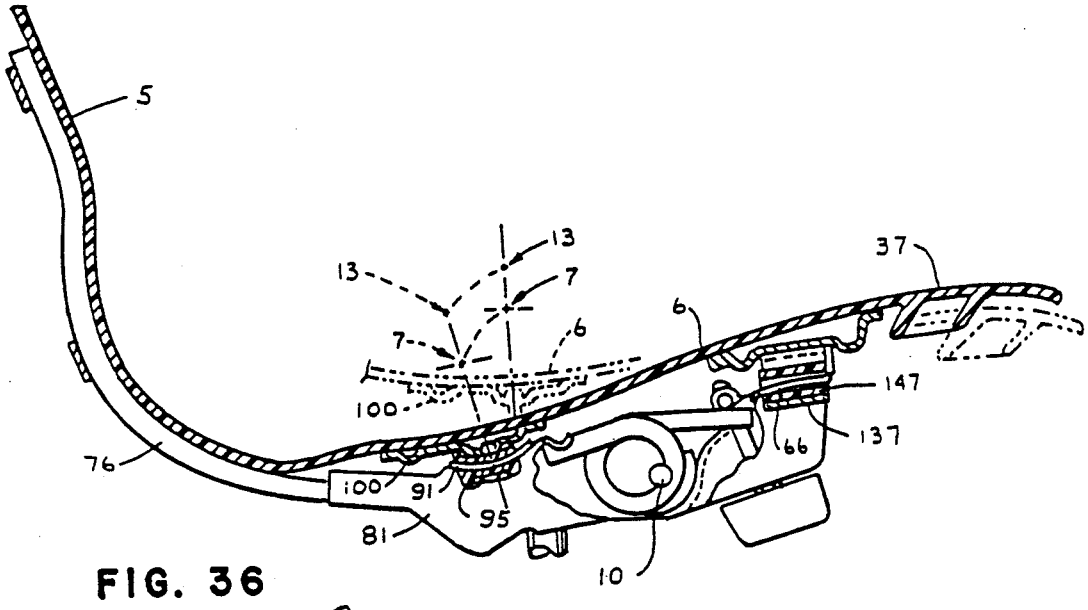
FIG. 36 is a fragmentary, vertical cross-sectional view of the chair, shown in the rearwardly tilted position, and occupied, with the front portion of the chair bottom positioned fully upwardly, and wherein broken lines illustrate the position of the chair in the upright position.

The reference numeral 1 (FIGS. 1–3) generally designates a unique integrated chair and control arrangement, which is the subject of co-pending U.S. Pat. application Ser. No. 850,268, filed Apr. 10, 1986, entitled INTEGRATED CHAIR AND CONTROL, and comprises a chair 2, and a control 3 therefor Integrated chair and control arrangement 1 is shown herein as incorporated in a tilt back type of chair 2. Chair 2 includes a base 4, a backrest or chair back 5, and a seat or chair bottom 6, which are interconnected for mutual rotation about a common or synchrotilt axis 7. Control 3 includes a normally stationary support or housing 8, and a back support 9 rotatably connecting chair back 5 with housing 8 to permit rotation therebetween about a back pivot axis 10 (FIGS. 6 and 7). Control 3 (FIG. 3) also includes a bottom support 11 rotatably connecting chair bottom 6 with housing 8 to permit rotation therebetween about a bottom pivot axis 12 (FIGS. 31 and 32). As best illustrated in FIG. 34, the common or synchrotilt axis 7 is located above chair bottom 6, forward of chair back 5, and generally adjacent to the hip joint axis, or "H" point 13 of a seated user. Rearward tilting of chair back 5 simultaneously shifts chair back 5, chair bottom 6, and the location of common axis 7 in a manner which maintains the adjacent spatial relationship between the common axis 7 and the "H" point 13 to provide improved user comfort and support.

Figure 4:
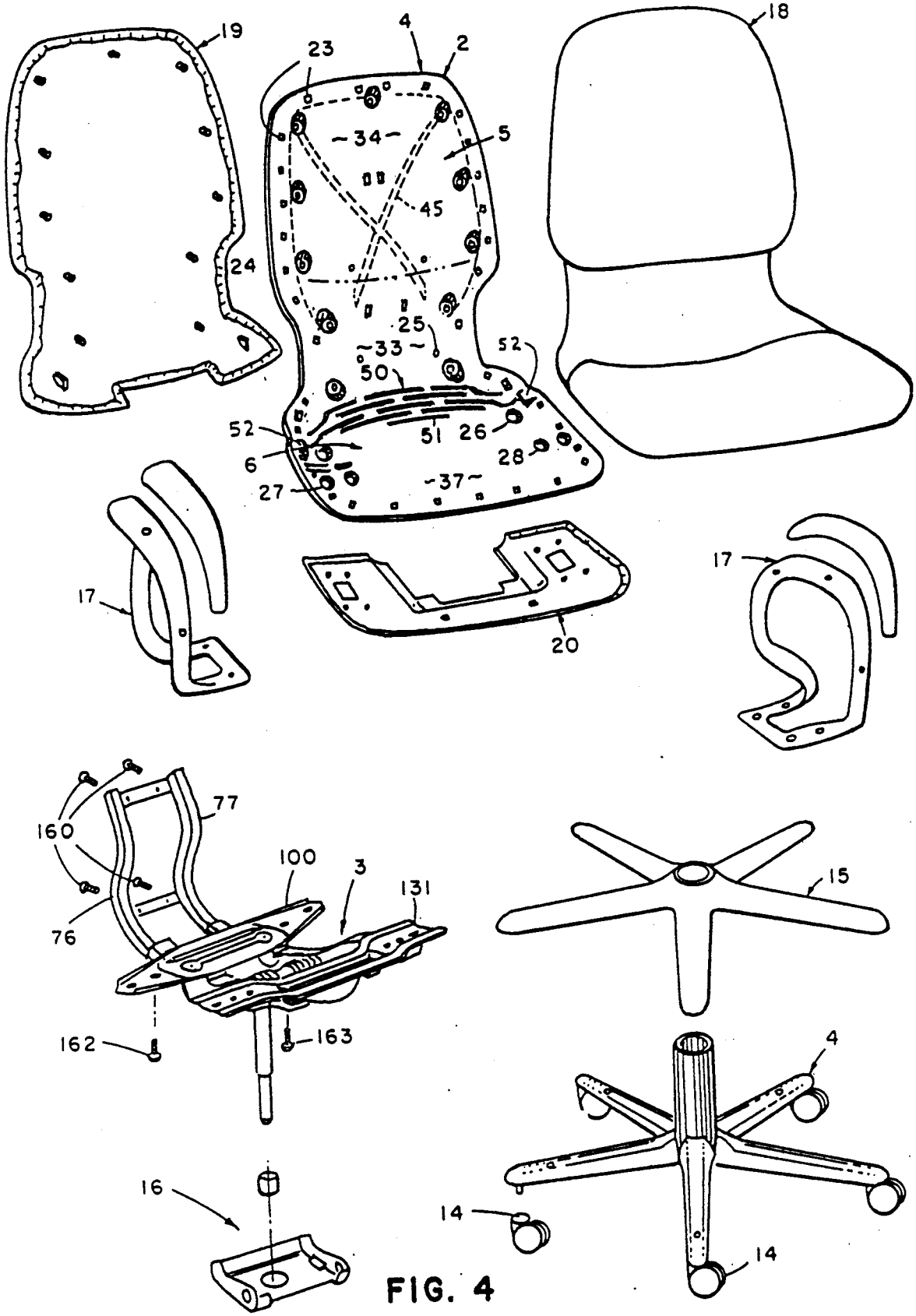
FIG. 4 is an exploded, perspective view of the chair.

With reference to FIG. 4, chair 2 has a sleek, one-piece design, and incorporates several unique features, some of which are the subject of the present patent application, and some of which are the subject of separate, co-pending U.S. patent applications, as identified below. Chair 2 is supported on base 4, which includes casters 14 and a molded cap 15 that fits over the legs of base 4. Control 3 is mounted on base 4, and includes a lower cover assembly 16. Chair 2, along with left-hand and right-hand arm assemblies 17, are supported on control 3. A molded cushion assembly 18, which is the subject of a separate, co-pending U.S. Pat. application Ser. No. 850,292, filed Apr. 10, 1986, and entitled CUSHION MOLDING PROCESS, is attached to the front surface of chair 2 through fastener apertures 23, and provides a continuous, one-piece comfort surface on which the user sits. A rear, cover shell assembly 19 is attached to the rear surface of chair 2, through fastener apertures 24, and a bottom shell assembly 20 is attached to the bottom of chair 2 by conventional fasteners (not shown).

Figure 5:
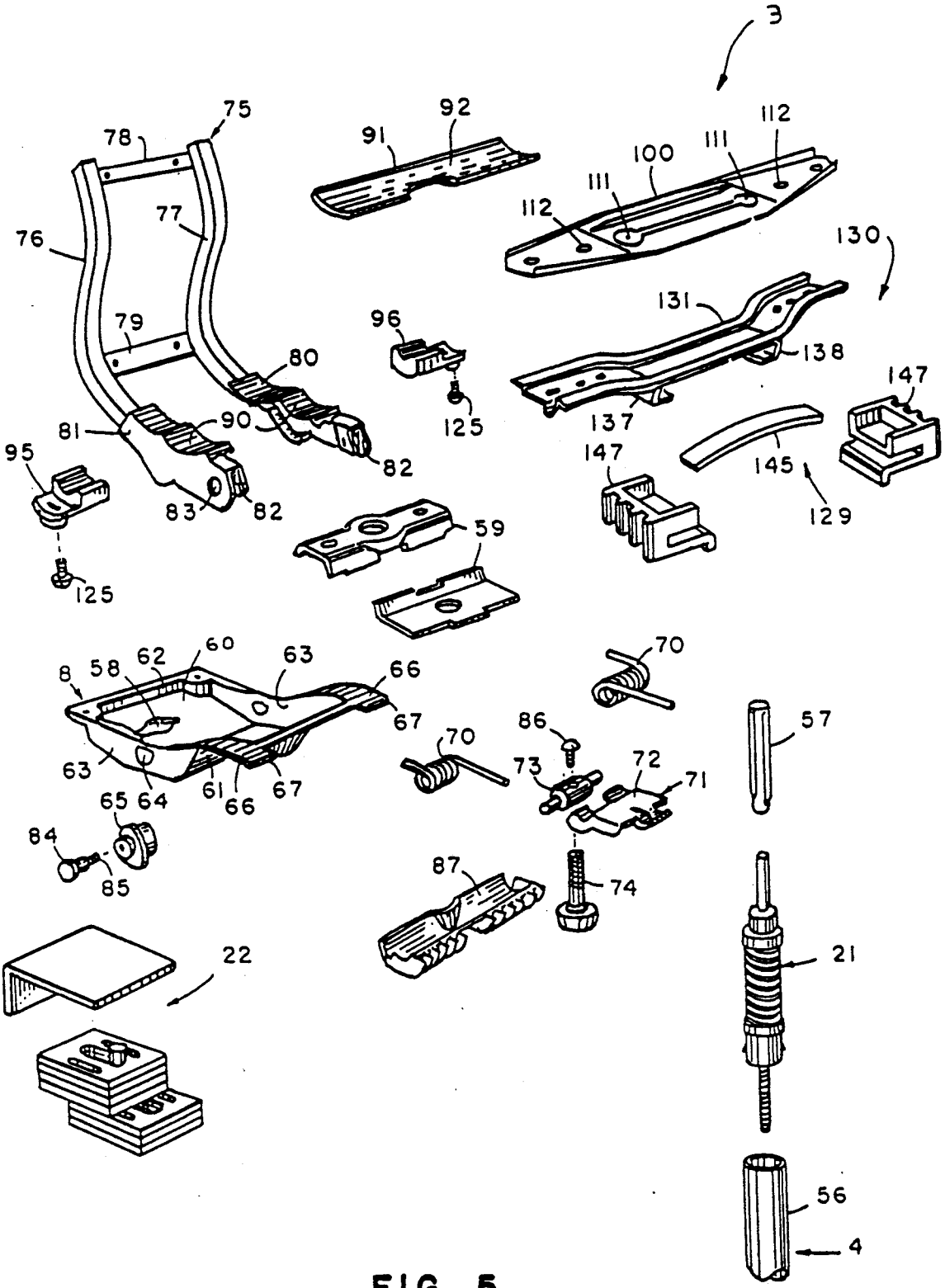
FIG. 5 is an exploded, perspective view of the control.

With reference to FIG. 5, chair 2 also includes a weight actuated, height adjuster assembly 21, which is the subject of a separate, co-pending U.S. Pat. application Ser. No. 850,510, filed Apr. 10, 1986, and entitled SLIP CONNECTOR FOR WEIGHT ACTUATED HEIGHT ADJUSTORS. A variable back stop assembly 22, which is the subject of a separate, co-pending U.S. Pat. application, Ser. No. 850,508, filed Apr. 10, 1986, entitled VARIABLE BACK STOP, is also provided on control 3 to adjustably limit the rearward tilting action of chair back 5.

In the illustrated chair 2 (FIG. 4), cushion assembly 18 is a molded, one-piece unit that has three separate areas which are shaped and positioned to imitate or mirror the human body. Chair back 5 and chair bottom 6 are also molded in a unitary or integral shell **2*a*, which serves to support cushion assembly 18 in a manner that allows the user to move naturally and freely in chair 2 during the performance of all types of tasks and other activities. Chair shell 2*a* is the subject of a separate, co-pending U.S. Pat. application Ser. No. 850,505, filed Apr. 10, 1986, and entitled CHAIR SHELL WITH SELECTIVE BACK STIFFENING. Chair shell 2*a* is constructed of a resilient, semi-rigid, synthetic resin material, which normally retains its molded shape, but permits some flexing, as described in greater detail below. Chair shell 2*a*** includes two sets of fastener apertures 23 and 24, as well as five sets of threaded fasteners 24–28 mounted therein to facilitate interconnecting the various parts of chair 2, as discussed hereinafter.

Figure 13:
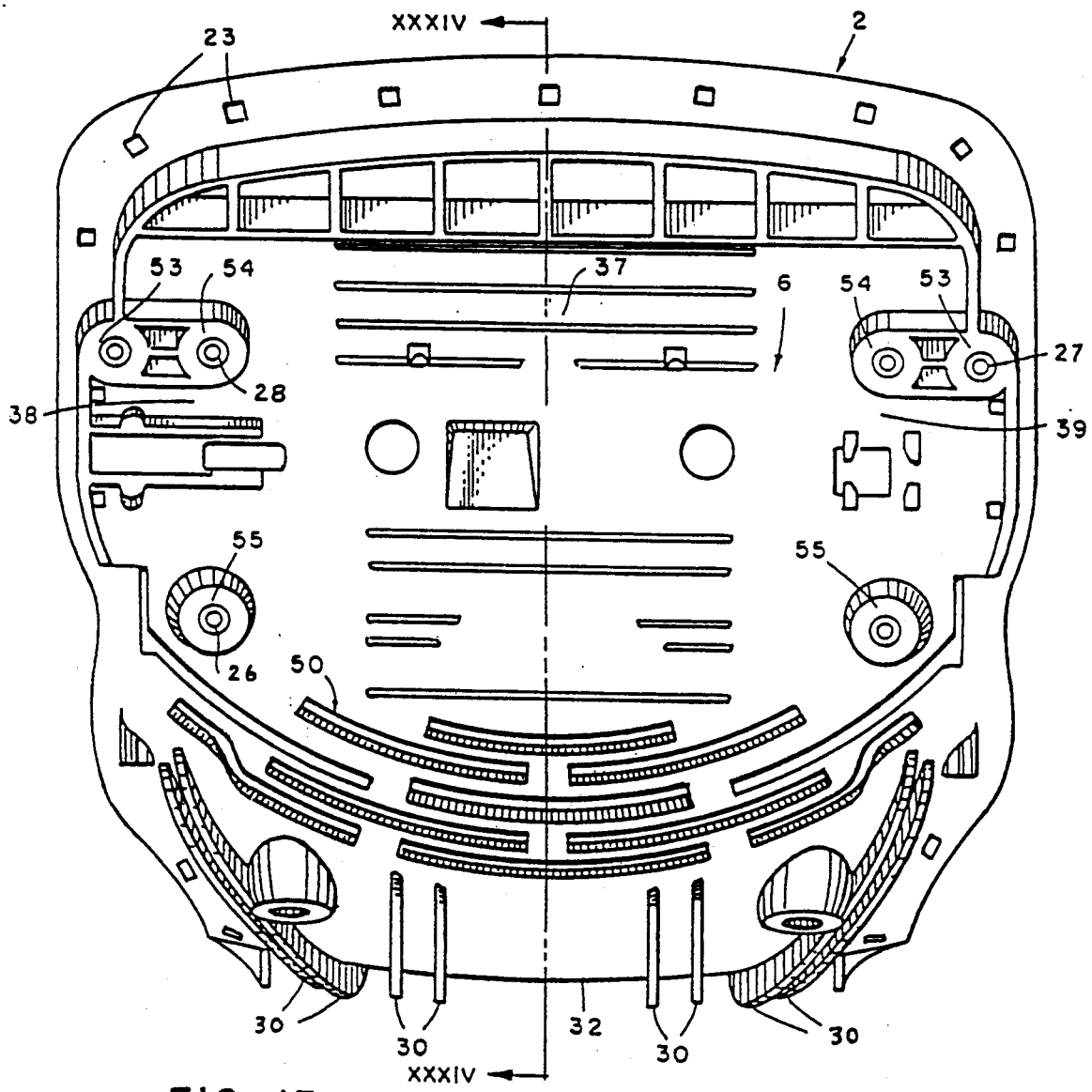
FIG. 13 is a bottom plan view of the shell.
Figure 17:
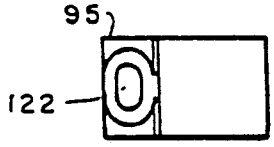
FIG. 17 is a bottom plan view of a bearing pad portion of the control.
Figure 18:
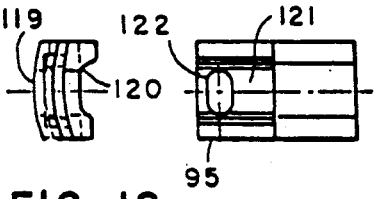
FIG. 18 is a side elevational view of the bearing pad.

As best illustrated in FIGS. 13–15, chair shell 2a comprises a relatively thin, formed sheet 12, with a plurality of integrally molded, vertically extending ribs 30 on the back side thereof. Ribs 30 extend from a rearward portion 31 of chair bottom 6 around a curved center or intermediate portion 32 of chair shell 2a, which is disposed between chair back 5 and chair bottom 6. Ribs 30 extend along a lower portion 33 of chair back 5. In the illustrated example, chair shell 2a has eight ribs 30, which are arranged in regularly spaced apart pairs, and are centered symmetrically along the vertical centerline of chair shell 2a. Ribs 30 protrude rearwardly from the back surface of chair back 5 a distance in the nature of ½ to one inch. Ribs 30 define vertically extending slots 46 in which associated portions of control 3 are received, as described below. The sheet 29 of chair shell 2a is itself quite pliable, and will therefore bend and flex freely in either direction normal to the upper and lower surfaces of sheet 29. Ribs 30 serve to selectively reinforce or stiffen sheet 29, so that it will assume a proper configuration to provide good body support along the central portions of chair shell 2a, yet permit flexure at the peripheral or marginal portions of chair shell 2a. Ribs 30, in conjunction with uprights 76 and 77, define a substantially rigid portion of chair shell 2a, which does not readily bend or flex in a vertical plane, and generally corresponds to the spine area of a seated user.

The marginal portion of chair back 5 (FIG. 14), which is disposed outwardly from ribs 30, is divided into an upper portion 34, a left-hand portion 35, and a right-hand portion 36. That portion of chair bottom 6 (FIG. 13) which is located outwardly from ribs 30, includes a forward portion 37, a right-hand portion 38, and a left-hand portion 39.

Figures 8, 9, 10:
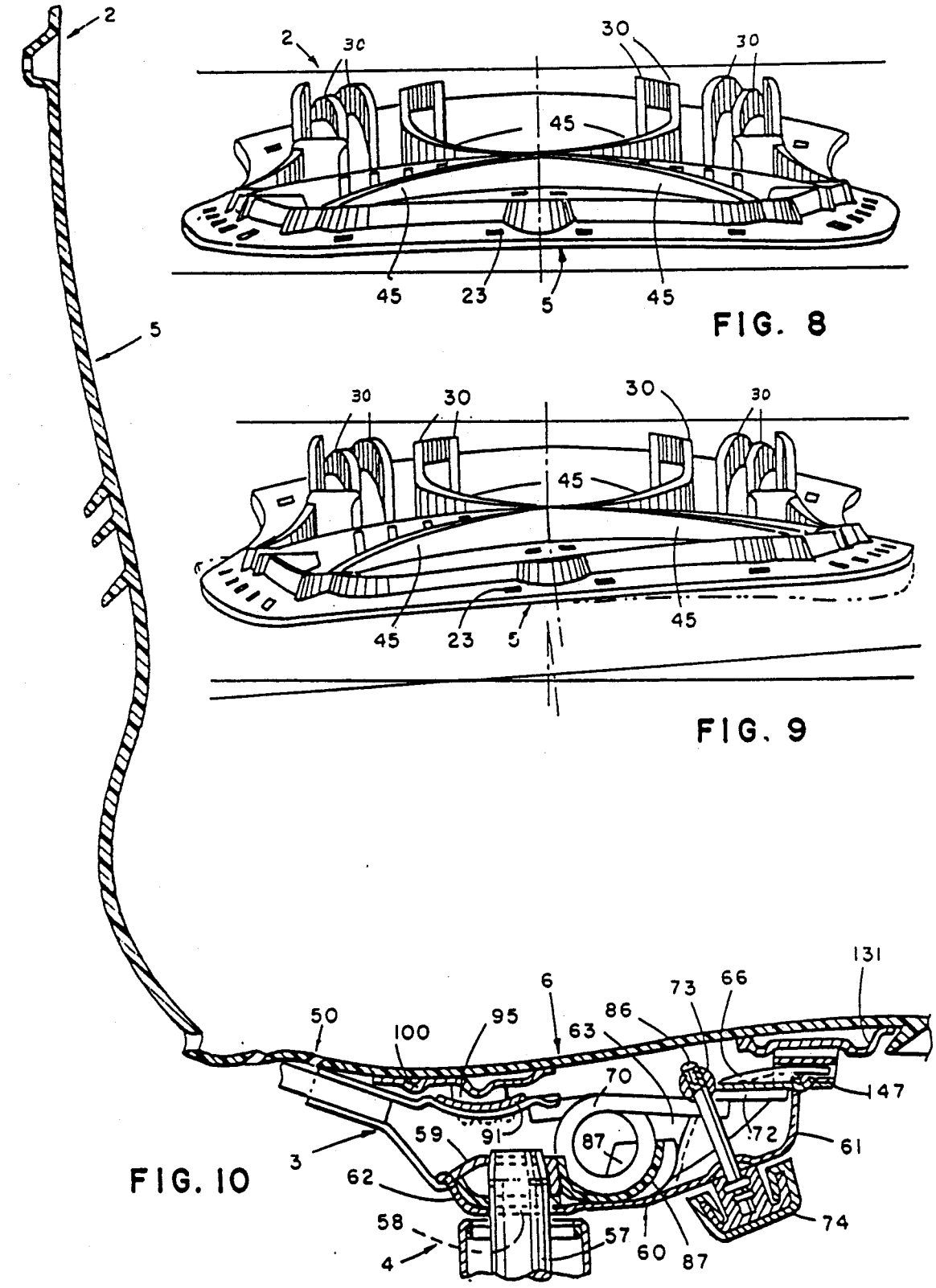
FIG. 8 is a top plan view of a back portion of the shell, shown in position.
FIG. 9 is a top plan view of the shell, shown in the upright position, with one side flexed rearwardly.
FIG. 10 is a vertical cross-sectional view of the chair.

A second set of ribs 45 (FIG. 14) are integrally formed on the back surface of chair shell 2a, and are arranged in an "X" shaped configuration thereon. Ribs 45 extend from the upper portion 34 of chair back 5, at the upper ends of vertical ribs 30, downwardly across the surface of chair back 5, and terminate at points located adjacent to the inwardmost pair of vertical ribs 30. Ribs 45 intersect on chair back 5 at a location approximately midway between the top and bottom of chair back 5. Ribs 45, along with ribs 30, selectively rigidify the upper portion of chair back 5 to prevent the same from buckling when rearward force or pressure is applied thereto. However, ribs 30 and 45 permit limited lateral flexing about a generally vertical axis, and in a generally horizontal plane, as illustrated in FIGS. 8 and 9, to create additional freedom of movement for the upper portion of the user's body, as described in greater detail hereinafter.

Figure 11:
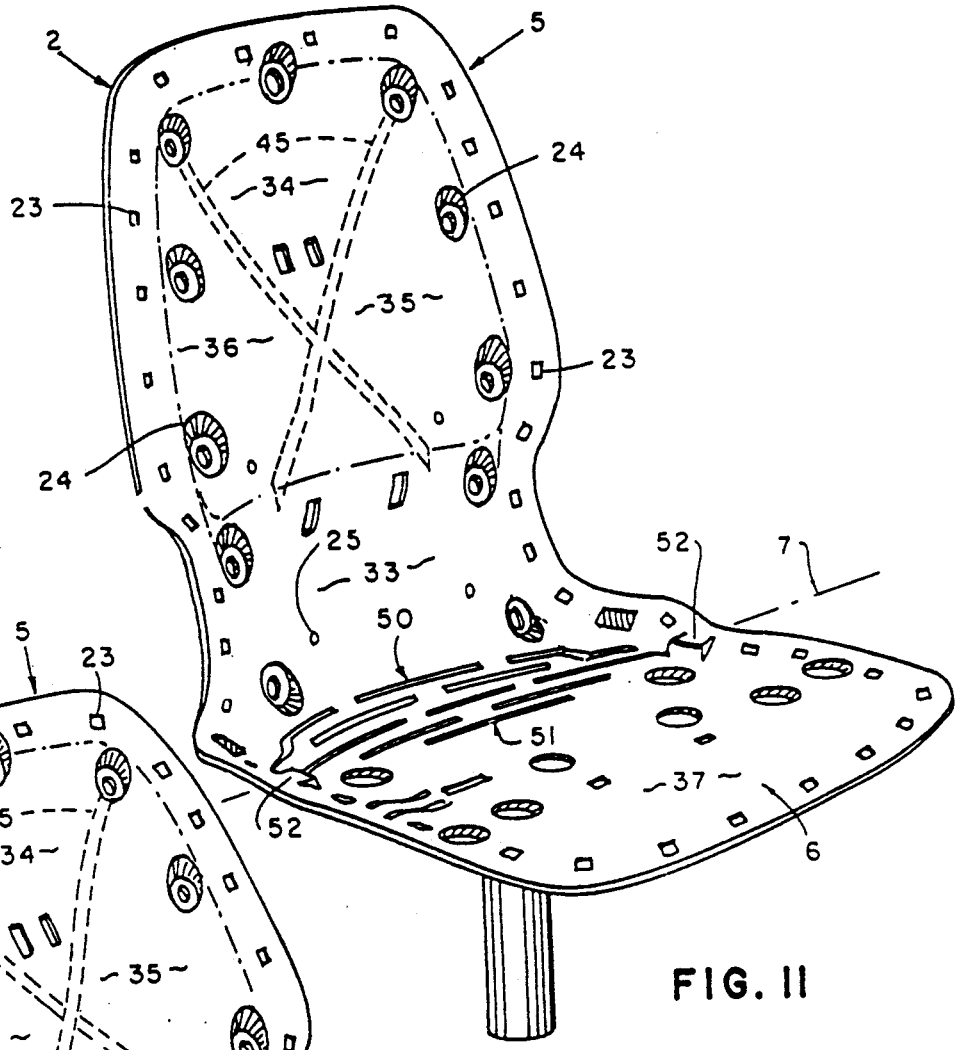
FIG. 11 is a perspective view of the chair, shown in the upright position.
Figure 12:
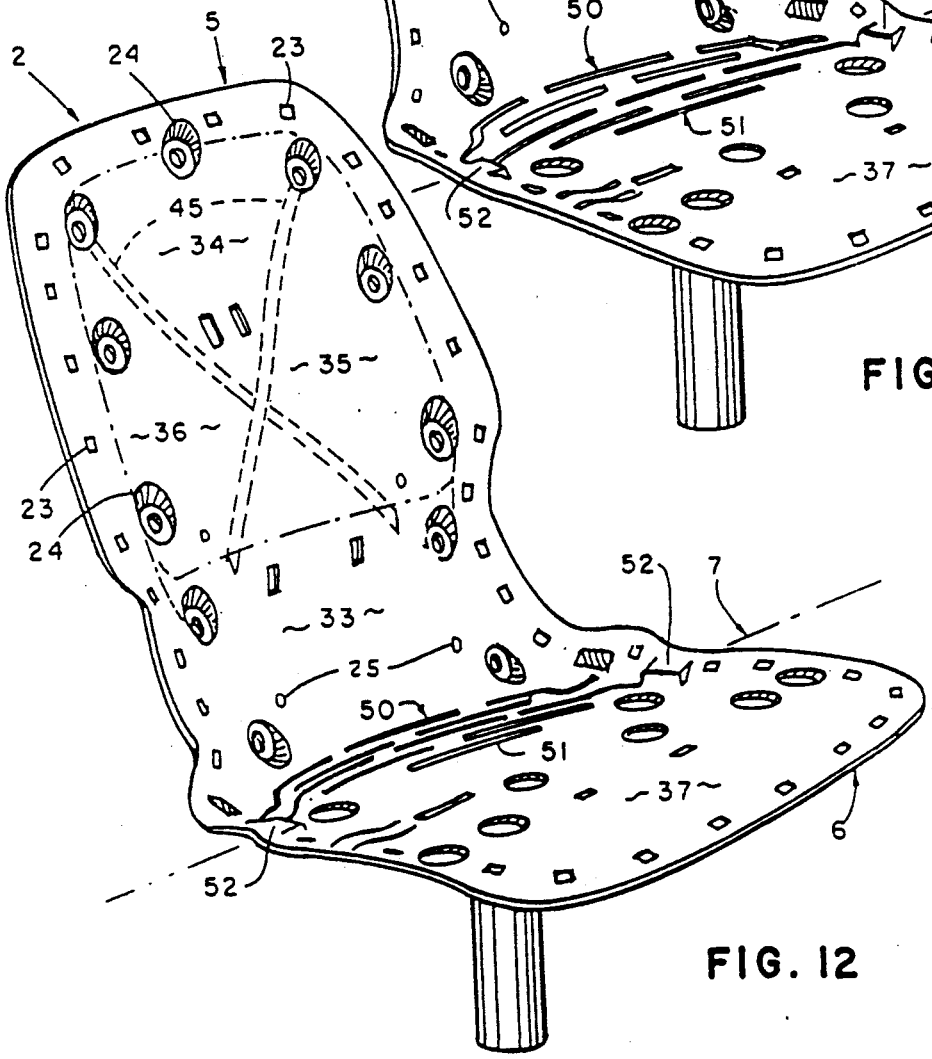
FIG. 12 is a perspective view of the chair, shown in the rearwardly position.

Chair shell 2a (FIG. 13) includes a generally arcuately shaped flex area 50 located immediately between the rearward and forward portions 31 and 3 respectively of chair bottom 6. As best shown in FIGS. 11 and 12, since chair shell 2a is a molded, one-piece unit, flex area 50 is required to permit chair back 5 to pivot with respect to chair bottom 6 along synchrotilt axis 7. In the illustrated example, flex area 50 comprises a plurality of elongated slots 51 that extend through chair shell 2a in a predetermined pattern. Slots 51 selectively relieve chair shell 2a at the flex area 50, and permit it to flex, simulating pure rotation about synchrotilt axis 7.

A pair of hinges 52 (FIGS. 11 and 12) rotatably interconnect chair back 5 and chair bottom 6, and serve to locate and define synchrotilt axis 7. In the illustrated example, hinges 52 comprise two, generally rectangularly shaped, strap-like living hinges, positioned at the outermost periphery of shell 2a. The opposite ends of living hinges 52 are molded with chair back 5 and chair bottom 6, and integrally interconnect the same. Living hinges 52 bend or flex along their length, to permit mutual rotation of chair back 5 and chair bottom 6 about synchrotilt axis 7, which is located near the center of living hinges 52. Living hinges 52 are located at the rearward, concave portion of chair bottom 6, thereby positioning synchrotilt axis 7 adjacent to the hip joints of a seated user, above the central area of chair bottom 6, and forward of chair back 5. In this example, synchrotilt axis 7, is located at a level approximately halfway between the upper and lower surfaces of living hinges 52.

Figure 38:
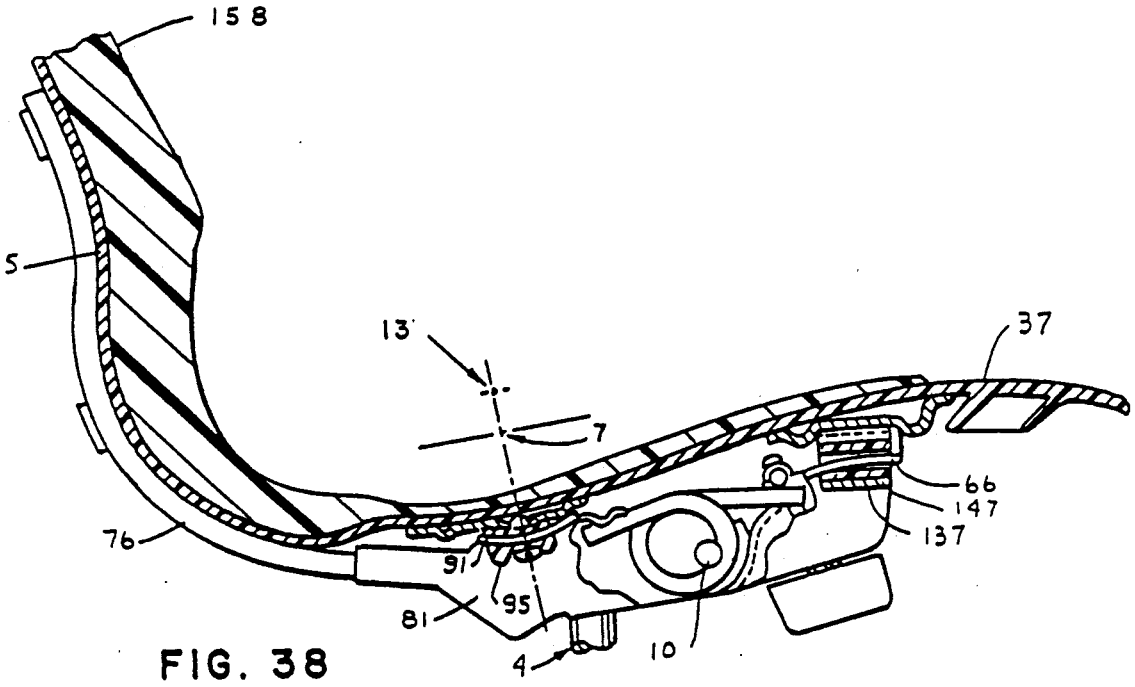
FIG. 38 is a fragmentary, vertical cross-sectional view of the chair, shown in the rearwardly tilted position, and occupied, with the forward portion of the chair bottom positioned fully downwardly.
Figure 39:
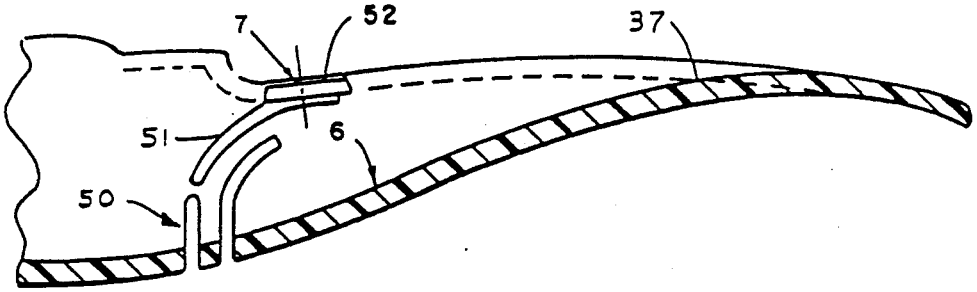
FIG. 39 is a fragmentary, enlarged vertical cross-sectional view of the chair bottom, taken along the line XXXIX—XXXIX of FIG. 3.

When viewing chair 2 from the front, as shown in FIG. 4, chair shell 2a has a somewhat hourglass shape, wherein the lower portion 33 of chair back 5 is narrower than both the upper portion 34 of chair back 5, and the chair bottom 6. Furthermore, the rearward portion 31 of chair bottom 6 is bucket-shaped or concave downwardly, thereby locating living hinges 52 substantially coplanar with the synchrotilt axis 7, as best shown in FIG. 38. The forward portion 37 of chair bottom 6 is relatively flat, and blends gently into the concave, rearward portion 31 of chair bottom 6. Three pair of mounting pads 53–55 (FIG. 13) are molded in the lower surface of chair bottom 6 to facilitate connecting the same with control 3, as discussed below.

Castered base 4 (FIG. 5) includes two vertically telescoping column members 56 and 57. The upper end of upper column member 57 is closely received in a mating socket 58 in control housing 8 to support control housing 8 on base 14 in a normally, generally stationary fashion.

Control housing 8 (FIGS. 5 and 10) comprises a rigid, cup-shaped, formed metal structure having an integrally formed base 60, front wall 61, rear wall 62, and opposite sidewalls 63. A laterally oriented bracket 59 is rigidly attached to housing base 60 and sidewalls 63 to reinforce control housing 8, and to form column socket 58. Control housing 8 includes a pair of laterally aligned bearing apertures 64 through housing sidewalls 63, in which a pair of antifriction sleeves or bearings 65 are mounted. A pair of strap-like, arcuately shaped rails 66 are formed integrally along the upper edges of housing sidewalls 63, at the forward portions thereof. Rails 66 extend or protrude slightly forwardly from the front edge of control housing 8. In the illustrated example, rails 66 have a generally rectangular, vertical cross-sectional shape, and are formed or bent along a downwardly facing arc, having a radius of approximately 4-½ to 5-½ inches, with the center of the arc aligned generally vertically with the forward ends 67 of rails 66, as shown in FIGS. 6 and 34. The upper and lower surfaces of rails 66 are relatively smooth, and are adapted for slidingly supporting chair bottom 6 thereon.

Control 3 also includes an upright weldment assembly 75 (FIG. 5) for supporting chair back 5. Upright weldment assembly 75 includes a pair of rigid, S-shaped uprights 76 and 77, which are spaced laterally apart a distance substantially equal to the width of rib slots 46, and are rigidly interconnected by a pair of transverse straps 78 and 79. A pair of rear stretchers 80 and 81 are fixedly attached to the lower ends of upright 76 and 77, and include clevis type brackets 82 at their forward ends in which the opposing sidewalls 63 of control housing 8 are received. Clevis brackets 82 include aligned, lateral apertures 83 therethrough in which axle pins 84 with flareable ends 85 are received, through bearings 65 to pivotally attach upright weldment assembly 75 to control housing 8. Bearings 65 are positioned such that the back pivot axis 9 is located between the forward portion 37 and the rearward portion 31 of chair bottom 6. As a result, when chair back 5 tilts rearwardly, the rearward portion 31 of chair bottom 6, along with synchrotilt axis 7, drops downwardly with chair back 5. In the illustrated structure, back pivot axis 10 is located approximately 2-½ to 3-½ inches forward of synchrotilt axis 7, and around 3 to 4 inches below synchrotilt axis 7, such that chair back 5 and the rearward portion 31 of chair bottom 6 drop around 2 to 4 inches when chair back 5 is tilted from the fully upright position to the fully rearward position.

As best illustrated in FIGS. 5 and 10, control 3 includes a pair of torsional springs 70, and a tension adjuster assembly 71 to bias chair 2 into a normally, fully upright position. In the illustrated structure, tension adjuster assembly 71 comprises an adjuster bracket 72 having its forward end pivotally mounted in the front wall 61 of control housing 8. The rearward end of adjuster bracket 72 is fork-shaped to rotatably retain a pin 73 therein. A threaded adjustment screw 74 extends through a mating aperture in housing base 60, and has a knob mounted on its lower end, and its upper end is threadedly mounted in pin 73. A stop screw 86 is attached to the upper end of adjuster screw 74, and prevents the same from inadvertently disengaging. Torsional springs 70 are received in control housing 8, and are mounted in a semicylindrically shaped, ribbed spring support 87. Torsional springs 70 are positioned so that their central axes are oriented transversely in control housing 8, and are mutually aligned. The rearward legs of torsional springs 70 (FIG. 10) abut the forward ends of clevis brackets 81, and the forward legs of torsional springs 70 are positioned beneath, and abut adjuster bracket 72. Rearward tilting of chair back 5 pushes the rear legs of torsional springs 70 downwardly, thereby further coiling or tensing the same, and providing resilient resistance to the back tilting of chair back 5. Torsional springs 70 are pretensed, so as to retain chair 2 in its normally, fully upright position, wherein chair back 5 is angled slightly rearwardly from the vertical, and chair bottom 6 is angled slightly downwardly from front to rear from the horizontal, as shown in FIGS. 6, 10, 11, 33 and 34. Rotational adjustment of adjuster screw 74 varies the tension in torsional springs 70 to vary both the tilt rate of chair back 5, as well as the pretension in springs 70.

Rear stretchers 80 and 81 (FIG. 5) include upwardly opening, arcuately shaped support areas 90. A rigid, elongate, arcuately shaped cross stretcher 91 is received on the support areas 90 of rear stretchers 80 and 81, and is fixedly attached thereto by suitable means such as welding or the like. Cross stretcher 91 is centered on rear stretchers 80 and 81, and the outward ends of cross stretcher 91 protrude laterally outwardly from rear stretchers 80 and 81. In the illustrated example, stretcher 91 comprises a rigid strap, constructed from formed sheet metal. The upper bearing surface 92 of cross stretcher 91 is in the shape of an arc, which has a radius of approximately 1-½ to 2-½ inches. The center of the arc formed by bearing surface 92 is substantially concentric with the common or synchrotilt axis 7, and in fact defines the synchrotilt axis about which chair back 5 rotates with respect to chair bottom 6. Cross stretcher 91 is located on rear stretchers 80 and 81 in a manner such that the longitudinal centerline of upper bearing surface 92 is disposed generally vertically below or aligned with synchrotilt axis 7 when chair 4 is in the fully upright position.

Figure 20:
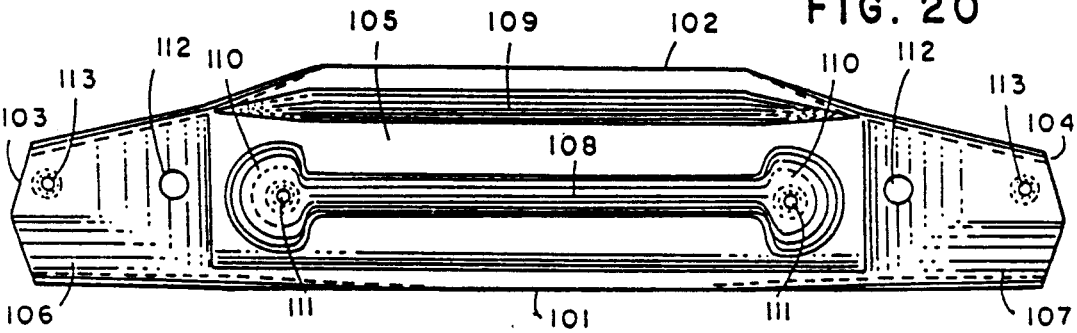
FIG. 20 is a bottom plan view of a rear arm strap portion of the control.

Control 3 further comprises a rigid, rear arm strap 100, which as best illustrated in FIG. 20, has a somewhat trapezoidal plan configuration, with forward and rearward edges 101 and 102, and opposite end edges 103 an 104. Rear arm strap 100 includes a central base area 105, with upwardly bent wings 106 and 107 at opposite ends thereof. Arm strap base 105 includes two longitudinally extending ribs 108 and 109 which protrude downwardly from the lower surface of arm strap base 105, and serve to strengthen or rigidify rear arm strap 100. Rib 108 is located adjacent to the longitudinal centerline of arm strap 100, and rib 109 is located adjacent to the rearward edge 102 of arm strap 100. Both ribs 108 and 109 have a substantially semicircular vertical cross-sectional shape, and the opposite ends of rib 108 open into associated depressions or cups 110 with threaded apertures 111 therethrough. The wings 106 and 107 of rear arm strap 100 each include two fastener apertures 112 and 113.

Figure 19:
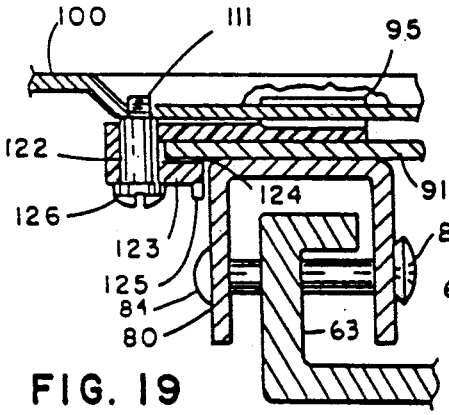
FIG. 19 is a vertical cross-sectional view of the bearing pad, shown in the control.
Figure 16:
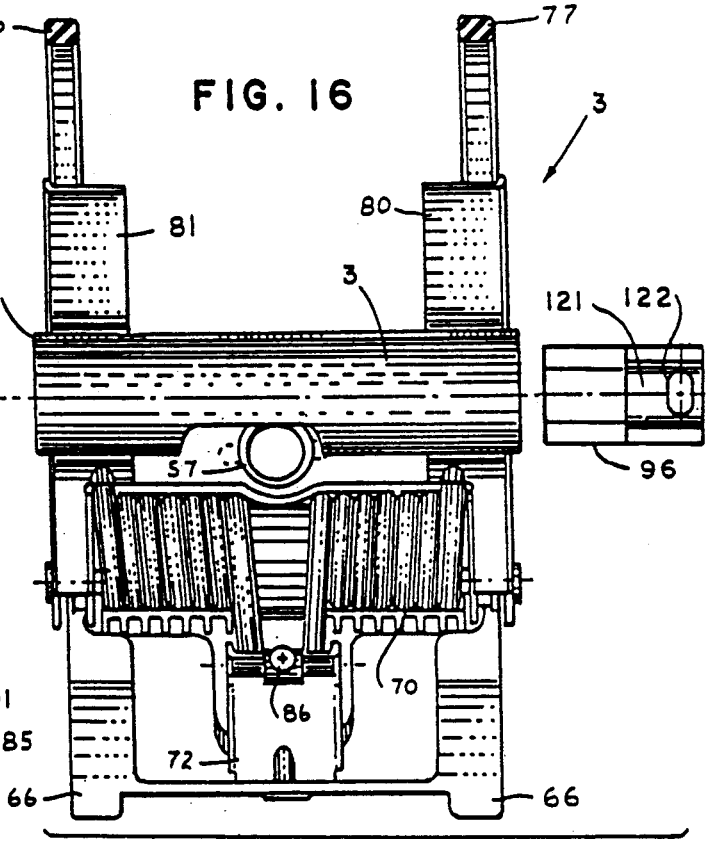
FIG. 16 is a top plan view of the control, wherein portions thereof have been removed and exploded away to reveal internal construction.

As best illustrated in FIGS. 16–19, bearing pads 95 and 96 are substantially identical in shape, and each has an arcuately shaped lower surface 119 which mates with the upper bearing surface 93 of cross stretcher 91. Bearing pads 95 and 96 also have arcuate grooves or channels 120 in their upper surfaces, which provide clearance for the center rib 108 of rear arm strap 100. Each bearing pad 95 and 96 includes an outwardly extending ear portion 121, with an elongate slot 122 therethrough oriented in the fore-to-aft direction. Integrally formed guide portions 123 of bearing pads 95 and 96 project downwardly from the lower surface 119 of pad ears 122, and form inwardly facing slots or grooves 124 in which the end edges of cross stretcher 91 are captured, as best illustrated in FIG. 19. The guide portions 123 of bearing pads 95 and 96 include shoulder portions 125, which are located adjacent to the outer sidewalls of rear stretchers 80 and 81. Shouldered screws 126, with enlarged heads or washers extend through bearing pad apertures 122, and have threaded ends received in mating threaded apertures 111 in rear arm bracket 100 to mount bearing pads 95 and 96 to the lower surface of rear arm bracket 100.

During assembly, bearing pads 95 and 96 are positioned on the upper bearing surface 92 of cross stretcher 91, at the opposite ends thereof, with the ends of cross stretcher 91 received in the grooves 124 of bearing pads 95 and 96. Rear arm strap 100 is positioned on top of bearing pads 95 and 96, with rib 108 received in the arcuate grooves 120 in the upper surfaces of pads 95 and 96. Shouldered fasteners 126 are then inserted through pad apertures 122, and screwed into threaded apertures 111 in rear arm strap 100, so as to assume the configuration illustrated in FIG. 3. As a result of the arcuate configuration of both bearing surface 92 and the mating lower surfaces 119 of bearing pads 95 and 96, fore-to-aft movement of rear arm strap 100 causes both rear arm strap 100, and the attached chair bottom 6, to rotate about a generally horizontally oriented axis, which is concentric or coincident with the common or synchrotilt axis 7.

A slide assembly 129 (FIG. 5) connects the forward portion 37 of chair bottom 6 with control 3 in a manner which permits fore-to-aft, sliding movement therebetween. In the illustrated example, slide assembly 129 includes a front arm strap assembly 130, with a substantially rigid, formed metal bracket 131 having a generally planar base area 132 (FIG. 21), and offset wings 133 and 134 projecting outwardly from opposite sides thereof. Two integrally formed ribs 135 and 136 extend longitudinally along the base portion 132 of front bracket 131 adjacent the forward and rearward edges thereof to strengthen or rigidify front bracket 131. Ribs 135 and 136 project downwardly from the lower surface of front bracket 131, and have a substantially semicircular vertical cross-sectional shape. A pair of Z-shaped brackets 137 and 138 ar mounted on the lower surface of front bracket 131, and include a vertical leg 139, and a horizontal leg 140.

With reference to FIGS. 22–30, front arm strap assembly 130 also includes a spring mechanism 145, which is connected with front bracket 131. Spring mechanism 145 permits the front lip 144 on the forward portion 37 of chair bottom 6 to move in a vertical direction, both upwardly and downwardly, independently of control 3, so as to alleviate undesirable pressure and/or the restricting of blood circulation in the forward portion of the user's legs and thighs. In the illustrated example, spring mechanism 145 comprises a laterally oriented leaf spring that is arcuately shaped in the assembled condition illustrated in FIG. 29. It is to be understood that although the illustrated chair 2 incorporates a single leaf spring 145, two or more leaf springs could also be used to support front bracket 131. The opposite ends of the illustrated leaf spring 145 are captured in a pair of guides 147. Guides 147 each have an upper, rectangular pocket 148 in which the associated leaf spring end is received, and a horizontally oriented slot 149 disposed below pocket 148, and extending through guide 147 in a fore-to-aft direction. When assembled, the center of leaf spring 145 is positioned between bracket ribs 135 and 136, and guides 147 are supported in brackets 137 and 138. The vertical legs 139 of brackets 137 and 138 have inwardly turned ends that form stops 150 (FIG. 23) which prevent spring 145 and guides 147 from moving forwardly out of brackets 137 and 138. The base portion 132 of front bracket 131 includes a downwardly protruding stop 151 formed integrally with rib 136, and is located directly behind the central portion of spring 145 to prevent spring 145 and guides 147 from moving rearwardly out of brackets 137 and 138. Hence, stops 150 and 151 provide a three point retainer arrangement that captures spring 145 and guides 147, and holds the same in their proper position on front bracket 131.

Spring 145 is normally a leaf spring that is generally parabolically shaped in the free condition, and is bent or preloaded into a more flattened, curved configuration, as shown in FIG. 29, to obtain the desired initial, and flexing support of chair bottom 6. In one embodiment of the present invention, spring 145 in its free state, has its center positioned approximately 1-½ to 1-¾ inches from the ends of spring 145, and is preloaded, so that its center is deflected approximately 0.300 to 0.400 inches from the spring ends. Preloading spring 145 not only provides the desired initial support and flexing action for chair bottom 6, but also renders the compression force of spring 145 relatively constant throughout its vertical travel to provide a very natural movement of chair bottom 6 in response to the shape and body motion of the user. For example, in the selected example discussed above, the force of spring 145 varies only approximately 25 to 30 percent over the entire vertical travel of the forward portion of chair bottom 6.

The height of guides 147 is substantially less than the height of mating brackets 137 and 138, so as to permit front bracket 131 to translate downwardly with respect to control housing 8 in the manner illustrated in FIG. 30. The upwardly bowed, center portion of preloaded spring 145 engages the center area of bracket base 132, and exerts a force on the guides 147. The horizontal legs 140 of brackets 137 and 138 resist the force exerted by preloaded spring 145, and retain spring 145 in place. The vertical deflection o motion of the chair bottom 6 is controlled or limited by abutting contact between guides 147 and mating brackets 137 and 138. When one, or both ends of spring 145 are depressed to a predetermined level, the upper edge of the associated guide 147 abuts or bottoms out on the bottom surface of front bracket 131 to prevent further deflection of that side of the forward portion 37 of chair bottom 6. In like manner, engagement between the lower edges of guides 147 and the horizontal legs 140 of brackets 137 and 138 prevents the associated side of chair bottom 6 from deflecting upwardly beyond a predetermined, maximum height. In one example of the present invention, a maximum deflection of ½ inch is achieved at the front edge of chair bottom 6 by virtue of preloaded spring 145.

The stiffness of spring 145 is selected so that the pressure necessary to deflect the forward portion 37 of chair bottom 6 downwardly is less than that which will result in an uncomfortable feeling or significantly disrupt the blood circulation in the legs of the user, which is typically considered to be caused by pressure of greater than approximately ½ to 1 pound per square inch. Hence, the forward portion 37 of chair bottom 6 is designed to move or adjust automatically and naturally as the user moves in the chair.

As explained in greater detail below, when the user applies sufficient pressure to the front portion 37 of chair bottom 6 to cause downward flexing of preloaded spring 145, not only does the front edge of chair bottom 6 move downwardly, but the entire chair bottom 6 rotates with respect to chair back 5 about synchrotilt axis 7. This unique tilting motion provides improved user comfort because the chair flexes naturally with the user's body, while at the same time maintains good support for the user's back, particularly in the lumbar region of the user's back. As discussed in greater detail below, the downward deflection of the front portion 37 of chair bottom 6 moves bearing pads 95 and 96 rearwardly over mating bearing surface 92, and causes the flex area 50 of chair 2 to bend a corresponding additional amount.

Front arm strap assembly 130 also permits the left hand and right hand sides of chair bottom 6 to flex or deflect vertically independently of each other, as well as independently of control 3, as illustrated in FIGS. 29 and 30, so that the chair automatically conforms with the shape and the movements of the seated user. Hence, when either the left leg or right leg of a seated user is shifted in a manner that includes a vertical component, the associated side of chair bottom 6 moves or flexes readily and independently of the other side of chair bottom 6 to closely follow this movement, thereby providing both improved comfort and support.

As best illustrated in FIGS. 33–38, the slots 149 in guides 147 are slidingly received over the outwardly protruding tracks 66 on control housing 8, and thereby permit the forward portion 37 of chair bottom 6 to move in a fore-to-aft direction with respect to control housing 8. Because tracks are oriented along a generally downwardly opening arcuate path, rearward translation of the front portion 37 of chair bottom 6 allows the same to rotate in a counterclockwise direction with respect to control housing 8, and about bottom pivot axis 12, as described in greater detail below.

Figure 21:
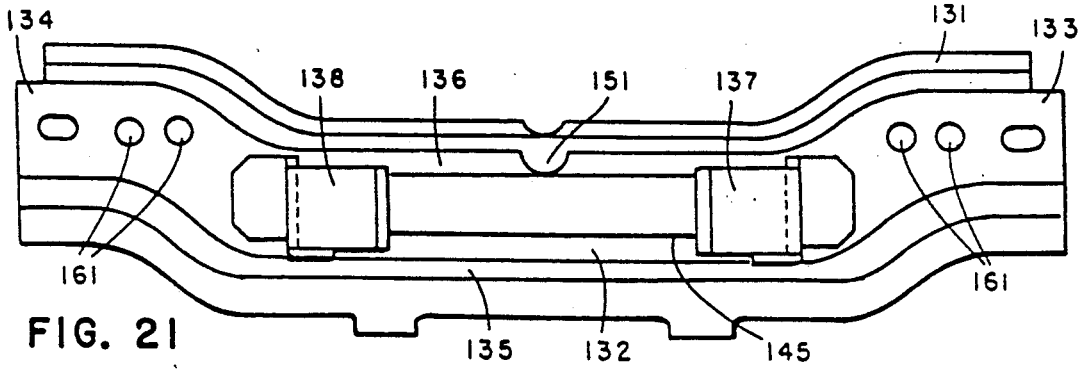
FIG. 21 is bottom plan view of a front arm strap portion of the control.

In the illustrated embodiment of the present invention, chair shell 2*a* (FIG. 4) is attached to control 3 in the following manner. Bearing pads 95 and 96 are assembled onto the opposite ends of cross stretcher 91. Chair shell 2*a* is positioned over control 3, with the slots 46 (FIG. 14) on the rear side of chair back 5 aligned with uprights 76 and 77. Rear arm strap 100 is adjusted on control 3, such that the mounting pads 55 (FIG. 13) on the lower surface of chair bottom 6 are received over mating fastener apertures 112 (FIG. 20) in rear arm strap 100. Fasteners 126 are inserted through bearing pads 95 and 96, and secured in the threaded apertures 111 of rear arm strap 100. Front arm strap assembly 130 is temporarily supported on chair bottom 6, with the mounting pads 53 and 54 (FIG. 13) on the lower surface of chair bottom 6 positioned on the wings 133 and 134 of front bracket 131, and aligned with mating fastener apertures 161 (FIG. 21).

The slots 149 in guides 147 are then aligned with the rails 66 of control housing 8. Next, chair back 5 is pushed rearwardly, so that uprights 76 and 77 are closely received in the mating slots 46, and extend downwardly along the outermost pair of ribs 30. As best illustrated in FIGS. 33–38, the "S" shape of chair shell 2*a* and uprights 75 and 76 is similar, so that the same mate closely together. Guides 147 are slidingly received on rails 66 to mount the forward portion 37 of chair bottom 6 on control 3. Four threaded fasteners 160 (FIG. 4) extend through mating apertures in upright straps 78 and 79, and are securely engaged in fastener nuts 25 mounted in chair back 5.

Bottom shell assembly 20 is then positioned in place below chair bottom 6. Threaded fasteners 163 (FIG. 4) are positioned through bottom shell assembly 20, and the fastener apertures 161 in front bracket 131, and are securely engaged in the mating mounting pads 53 and 54 of chair bottom 6 to mount front arm strap assembly 130 on chair bottom 6. Threaded fasteners 162 (FIG. 4) are positioned through bottom shell assembly 20, and the apertures 111 in rear arm strap 100, and are securely engaged in the mating mounting pads 55 of chair bottom 6 to mount the rearward portion 32 of chair bottom 6 on control 3.

When chair 2 is provided with arm assemblies 17, as shown in the illustrated example, the lower ends of the chair arms are positioned on the lower surface of chair bottom 6, and fasteners 162 and 163 extending through mating apertures in the same to attach arm assemblies 17 to the front and rear arm straps 100 and 131.

To best understand the kinematics of chair 2, reference is made to FIGS. 31 and 32, which diagrammatically illustrate the motion of chair back 5 with respect to chair bottom 6. The pivot points illustrated in FIGS. 31 and 32 are labeled to show the common axis 7, the back pivot axis 10, and the bottom pivot axis 12. It is to be understood that the kinematic model illustrated in FIGS. 31 and 32 is not structurally identical to the preferred embodiments of chair 2 as described and illustrated herein. This is particularly true insofar as the kinematic model illustrates chair bottom 6 as being pivoted about an actual bottom pivot axis 12 by an elongate arm, instead of the arcuate rails 66 and mating guides 147 of the illustrated chair 2, which rotate chair bottom 6 about a imaginary bottom pivot axis 12. In any event, as the kinematic model illustrates, the rate at which chair back 5 tilts with respect to a stationary point is much greater than the rate at which chair bottom 6 rotates with respect to the same stationary point, thereby achieving a synchrotilt tilting action. In the illustrated kinematic model, rotation of chair back 5 about back pivot axis 10 by a set angular measure, designated by the Greek letter Alpha, causes chair bottom 6 to rotate about bottom pivot axis 12 by a different angular measure, which is designated by the Greek letter Beta. In the illustrated example, the relationship between chair back angle Alpha and chair bottom angle Beta is approximately 2:1. Essentially pure rotation between chair back 5 and chair bottom 6 takes place about common axis 7. Pure rotation of chair back 5 takes place about back pivot axis 10. Chair bottom 6 both rotates and translates slightly to follow the motion of chair back 5. The 2:1 synchrotilt action is achieved by positioning bottom pivot axis 12 from common axis 7 a distance equal to twice the distance back pivot axis 10 is positioned from common axis 7. By varying this spatial relationship between common axis 7, back pivot axis 10 and bottom pivot axis 12, different synchrotilt rates can be achieved.

The kinematic model also shows the location of common axis 7 above chair bottom 6, and forward of chair back 5, at a point substantially coincident with or adjacent to the "H" point 13 of the user. As chair back 5 tilts rearwardly, common axis 7, along with the "H" point 13, rotate simultaneously about back pivot axis 10, along the arc illustrated in FIG. 32, thereby maintaining the adjacent spatial relationship between common axis 7 and the "H" point 13. Contemporaneously, chair bottom 6 and chair back 5 are rotating with respect to each other about the pivoting common axis 7 to provide synchrotilt chair movement. This combination of rotational motion provides a very natural and comfortable flexing action for the user, and also provides good back support, and alleviates shirt pull.

The kinematic model also illustrates the concept that in the present chair 2, hinges 52 are a part of shell 2*a*, not control 3. In prior art controls, the synchrotilt axis is defined by a fixed axle in the chair iron, and is therefore completely separate or independent from the supported shell. In the present chair 2, shell 2*a* and control 3 are integrated, wherein shell 2*a* forms an integral part of the articulated motion of chair 2.

Figure 33:
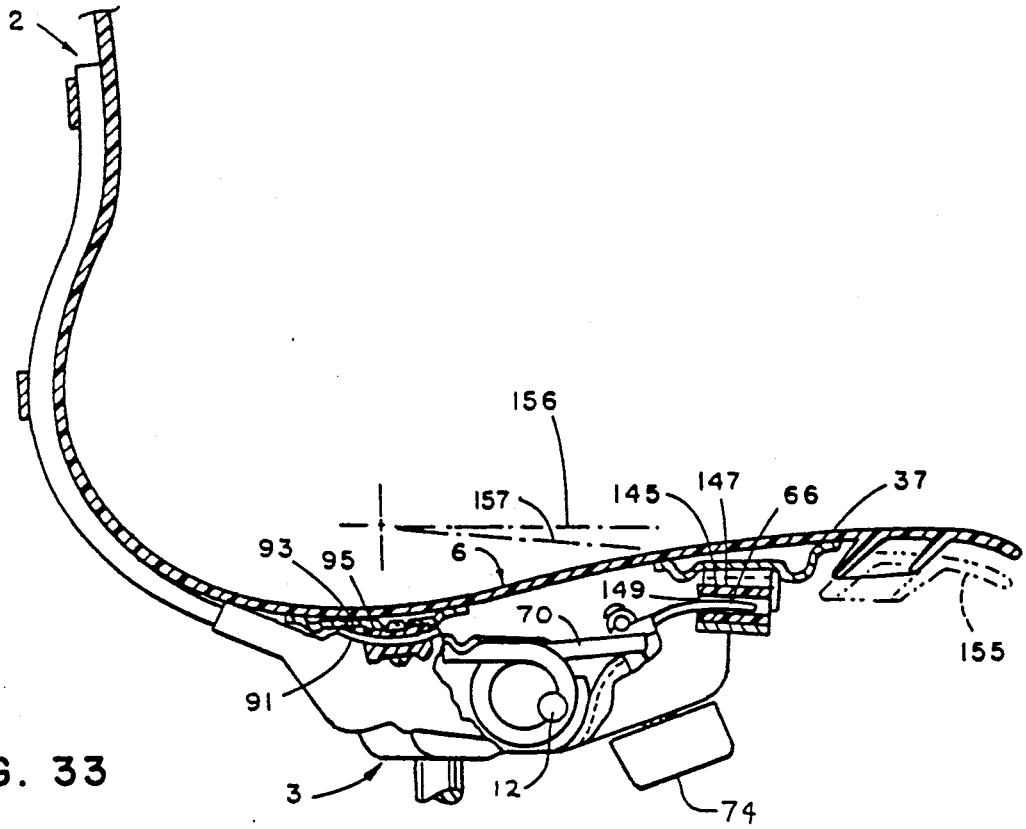
FIG. 33 is a fragmentary, vertical cross-sectional view of the chair, shown in the upright position, and unoccupied.

With reference to FIGS. 33–38, the kinematics of chair 2 will now be explained. In the fully upright, unoccupied position illustrated in FIG. 33, bearing pads 95 and 96 are oriented toward the forward edge of the bearing surface 93 on cross stretcher 91, and guides 147 are positioned near the forward edges of tracks 66. Spring 145 is fully curved and extended upwardly, such that the forward portion 37 of chair bottom 6 is in its fully raised condition, for the upright position of chair 2. The broken lines, designated by reference number 155 in FIG. 33, illustrate the position of the front portion 37 of chair bottom 6 when the same is flexed fully downwardly.

FIG. 34 illustrates chair 2 in the fully upright position, but with a user seated on the chair 2. FIG. 34 shows an operational condition, wherein the user has applied some slight pressure to the forward portion 37 of chair bottom 6, so as to cause a slight downward deflection of the same. It is to be understood that the front portion 37 of chair bottom 6 need not be so deflected by every user, but that this movement will vary according to whatever pressure, if any, is applied to the forward portion of the chair by the individual user. This pressure will vary in accordance with the height and shape of the user, the height of both the chair 4 and any associated work surface, and other similar factors. In any event, the forward portion 37 of chair bottom 6 moves or deflects automatically in response to pressure applied thereto by the legs of the user, so as to alleviate any uncomfortable pressure and/or disruption of blood circulation in the user's legs, and to provide maximum adjustability and comfort. When the forward portion 37 of chair bottom 6 is deflected downwardly, bearing pads 95 and 96 move rearwardly over the upper bearing surface 92 of cross stretcher 91, and guides 147 move very slightly rearwardly along tracks 66, in the manner illustrated in FIG. 34. Hence, when the user exerts pressure on the forward portion 37 of chair bottom 6, not only does the front edge 144 of the chair 2 drop or move downwardly, but the entire chair bottom 6 rotates about the common or synchrotilt axis 7, thereby providing improved user comfort and support. In one example of the present invention, maximum deflection of spring 145 causes chair bottom 6 to rotate approximately three degrees with respect to chair back 5 about synchrotilt axis 7, as shown by the imaginary planes identified by reference numerals 156 and 157 in FIG. 33.

Chair back 5 is tilted rearwardly by applying pressure or force thereto. Under normal circumstances, the user, seated in chair 4, tilts chair back 5 rearwardly by applying pressure to chair back 5, through force generated in the user's legs. When chair back 5 is tilted rearwardly, because back pivot axis 10 is located under the central or medial portion of chair bottom 6, the entire chair back 5, as well as the rearward portion 31 of chair bottom 6 move downwardly and rearwardly as they rotate about back pivot axis 10. In the illustrated example, the amount of such downward movement is rather substantial, in the nature of 2 to 4 inches. This motion pulls the forward portion 37 of chair bottom 6 rearwardly, causing guides 147 to slide rearwardly over tracks 66. Since guides 147 are in the shape of downwardly facing arcs, as chair back 5 is tilted rearwardly, the forward portion 37 of chair bottom 6 moves downwardly and rearwardly along an arcuate path. The downward and rearward movement of chair shell 2a also pulls bearing pads 95 and 96 slidingly rearwardly over the upper bearing surface 92 of cross stretcher 91. The upwardly opening, arcuate shape of bearing surface 92 and mating pads 95 and 96 causes the rearward portion 31 of chair bottom 6 to rotate with respect to chair back 5 in a clockwise direction, as viewed in FIGS. 33–38. The resultant motion of shell 2a is that chair back 5 rotates with respect to chair bottom 6 about common axis 7 to provide a comfortable and supportive synchrotilt action. As chair back 5 tilts rearwardly, synchrotilt axis 7 rotates simultaneously with chair back 5 about an arc having its center coincident with back pivot axis 10. In the illustrated example, when chair 2 is occupied by an average user, synchrotilt axis 7 is located approximately 1-½ inches above the supporting comfort surface 158 of chair bottom 6, and approximately 3-½ inches forward of the plane of supporting comfort surface 158 of chair back 5. The plane of supporting comfort surface 158 of chair back 5 is illustrated by the broken line in FIG. 6 identified by the reference numeral 153, and the exemplary distance specified above is measured along a horizontal line between synchrotilt axis 7 and back plane 153. Thus, synchrotilt axis 7 is located adjacent to, or within the preferred window or range of the empirically derived "H" point.

Figure 37:
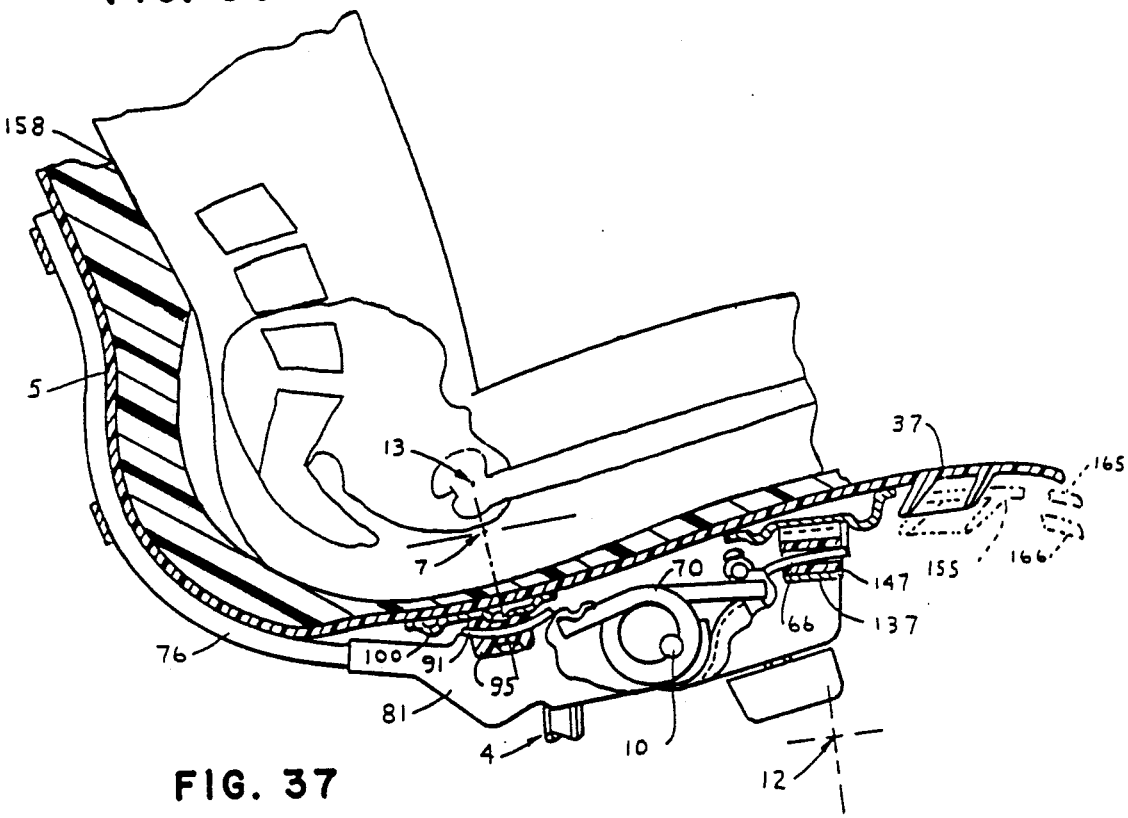
FIG. 37 is a fragmentary, vertical cross-sectional view of the chair, shown in the rearwardly tilted position, and occupied, with the forward portion of the chair bottom located fully upwardly, and wherein broken lines illustrate the position of the chair bottom in three different positions.

As best illustrated in FIG. 37, in the rearwardly tilted position, the forward portion 37 of chair bottom 6 can be deflected downwardly by virtue of spring 145. When spring 145 is deflected fully downwardly, in the position shown in dotted lines noted by reference numeral 155, bearing pads 95 and 96 assume their rearwardmost position on the upper bearing surface 93 of cross stretcher 91, and guides 147 move to their rearwardmost position on tracks 166. It is to be noted that by virtue of the front deflection available through spring 145, the user can realize substantially no lifting action at all at the front edge of chair bottom 6, so that chair bottom 6 does not exert undesirable pressure on the user's thighs, and the user's feet are not forced to move from the position which they assume when the chair is in the fully upright position. In other words, in the illustrated example, the amount of rise experienced at the forward edge of chair bottom 6 by virtue of tilting chair back 5 fully rearwardly is substantially equal to the maximum vertical movement achievable through spring 145.

Figure 3:
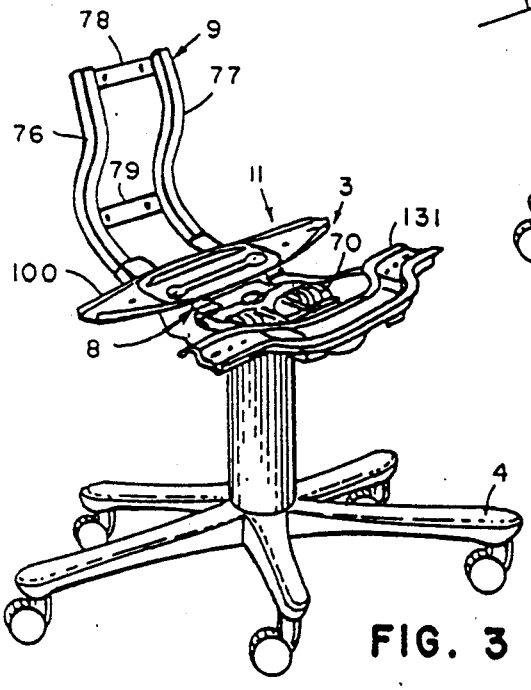
FIG. 3 is a perspective view of the chair, wherein the upholstery and shell have been removed to reveal a control portion present invention.

With reference to FIG. 37, the broken lines identified by reference numeral 165 illustrate the position of the forward portion 37 of seat bottom 6 when chair 2 is in the fully upright position, and forward seat portion 37 is in its fully raised, undeflected position. The broken lines identified by the reference numeral 166 in FIG. 3 illustrate the position of the forward portion 37 of seat bottom 6 when chair 2 is fully upright, and the forward seat portion 37 is in its fully lowered, deflected position.

As chair back 5 is tilted rearwardly, living hinges 52 bend, and flex area 50 deflects to permit mutual rotation of chair back with respect to chair bottom 6 about common axis 7. As best illustrated in FIG. 11, when chair back 5 is in the fully upright position, slots 46 are fully open, with the width of each slot being substantially uniform along its length. As chair back 5 tilts rearwardly, the rearward edges of slots 46 tend to fold under the corresponding forward edge of the slot to close the same slightly, and distort their width, particularly at the center portion of the flex area 50, as shown in FIG. 12. Flex area 50 is quite useful in holding the back 5 and bottom 6 portions of chair shell 2a together before chair shell 2a is assembled on control 3.

Chair shell ribs 30 and 45, along with uprights 76 and 77, provide substantially rigid support along the spine area of the chair shell 2a, yet permit lateral flexing of the upper portion 34 of chair back 5, as illustrated in FIGS. 8 and 9, so as to provide the user with improved freedom of movement in the upper portion of his body. This feature is the subject of a separate, co-pending U.S. Pat. application, Ser. No. 850,505, filed Apr. 10, 1986, entitled FLEXIBLE CHAIR SHELL WITH SELECTIVE BACK STIFFENING.

The controlled deflection front lip of the present invention, in conjunction with integrated chair and control 1, permit chair 2 to flex in a natural fashion in response to the shape and the motions of the user's body, and thereby optimize comfort in each and every chair position. Chair 2 incorporates a unique blend of mechanics and aesthetics, which imitate both the contour of the user's body and the movement of the user's body. Control 3 insures that the major rearward tilting motion of chair 4 is fully controlled in accordance with predetermined calculations to give the chair a safe and secure feel, and also to properly support the user's body in a good posture. The common or synchrotilt axis 7 is located ergonomically, adjacent to the hip joints, or "H" point of the seated user to provide improved comfort. When chair back 5 is tilted rearwardly, chair back 5, along with at least a portion of chair bottom 6, shift generally downwardly in a manner which simultaneously shifts the location of common axis 7 along a path which maintains its adjacent spatial relationship with the user's hip joints. As a result of this unique tilting action, improved lumbar support is achieved, and shirt pull is greatly alleviated.

The controlled deflection front lip permits the left hand and right hand sides of the forward portion 37 of chair bottom 6 to move vertically independently of each other, as well as independently of control 3. Chair shell 2*a* and control 3 interact as a unitary, integrated support member for the user's body, which senses the shape and movement of the user's body, and reacts naturally thereto, while providing improved postural support.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A chair, comprising:

a base;

a seat having a rearward portion thereof positioned to contact at least a portion of a buttock area of an adult user, and a forward portion thereof positioned to contact at least a portion of a thigh area of an adult user; said seat including means for permitting the forward portion of said seat to deflect with respect to and substantially independently of the rearward portion of said seat;

means for independently supporting the rearward portion of said seat on said base;

a spring mechanism independently supporting the forward portion of said seat on said base, and deflecting in response to upward and downward movement thereof, whereby body movement of a seated user deflects the forward portion of said seat upwardly and downwardly independently of the rearward portion of said seat to alleviate undesirable pressure at the thigh area of the user; said spring mechanism being preloaded to provide initial support, and relatively constant resilient resistance to the upward and downward movement of the forward portion of said seat throughout its range of travel; and wherein said spring mechanism includes a stop which positively limits the upward and downward movement of the forward portion of said seat.

2. A chair as set forth in claim 1, wherein:

said seat includes a left-hand portion and a right-hand portion at opposite sides thereof; and said spring mechanism includes means for permitting the left-hand and right-hand portions of said seat to deflect upwardly and downwardly independently of each other.

3. A chair as set forth in claim 2, wherein:

said spring mechanism comprises a leaf spring having a center portion thereof operably connected with one of said seat and said base, and opposite end portions thereof operably connected with the other of said seat and said base.

4. A chair as set forth in claim 3, wherein:

said leaf spring is oriented transversely across the forward portion of said seat.

5. A chair as set forth in claim 3, including:

first and second guides connected with the opposite end portions of said leaf spring;

first and second brackets connected with said seat and shaped to receive said first and second guides therein, and permit upward and downward movement therebetween; said brackets being positioned to retain said leaf spring in an arcuate, preloaded configuration, and permitting the opposite ends of said leaf spring to flex independently to define at least a portion of said means for permitting the left-hand and right-hand portions of said seat to move independently of each other.

6. A chair as set forth in claim 5, including:

means for connecting said first and second guides with said base; and means for positioning the center portion of said leaf spring to move with the forward portion of said seat, whereby downward movement of the forward portion of said seat tends to flatten the arcuate configuration of said leaf spring, thereby generating a biasing force which resists further downward movement of the forward portion of said seat.

7. A chair as set forth in claim 6, wherein:

said leaf spring is positioned in a downwardly opening orientation.

8. A chair as set forth in claim 7, wherein:

said first and second guides include upwardly opening pockets in which the opposite end portions of said leaf spring are closely received and retained.

9. A chair as set forth in claim 8, including:

a front bracket having an upper surface thereof on which said seat is operably connected, and supported, and a lower surface; and said first and second brackets are connected with and depending from the lower surface of said front bracket.

10. A chair as set forth in claim 9, wherein:

said first and second brackets are generally L-shaped, with sidewalls and bottom walls, and are positioned facing one another; and said first and second guides move vertically in said first and second brackets between the lower surface of said front bracket and the bottom walls of said first and second brackets.

11. A chair as set forth in claim 10, where said first and second guides include upper and lower surfaces which are positioned to abut the lower surface of said front bracket and the bottom walls of said first and second brackets as the forward portion of said seat moves between fully upward and fully downward positions to define at least a portion of said stop.

12. A chair as set forth in claim 11, wherein:

said seat has a one-piece, integrally formed, flexible construction which permits the forward portion of said seat to deflect with respect to the rearward portion of said seat.

13. A chair as set forth in claim 12, including:

a back operably connected with said seat, and positioned to selectively contact and support a back area of an adult user.

14. A chair as set forth in claim 13, including:

means for supporting said back on said base, and permitting said back to tilt rearwardly.

15. A chair as set forth in claim 14, wherein:

said base includes a control housing having outwardly protruding side flanges positioned along opposite sides thereof; and said first and second guides include inwardly facing slots into which said housing side flanges are received to mount said front arm bracket on said control housing.

16. A chair as set forth in claim 15, wherein:

said guide slots and said housing side flanges are shaped to permit sliding movement therebetween.

17. A chair as set forth in claim 6, wherein:

said seat has a one-piece, integrally formed, flexible construction which permits the forward portion of said seat to deflect with respect to the rearward portion of said seat.

18. A chair as set forth in claim 1, including:

a back operably connected with said seat, and positioned to selectively contact and support a back area of an adult user.

19. A chair as set forth in claim 18, including:

means for supporting said back on said base, and permitting said back to tilt rearwardly.

20. In a seat of the type having a normally, generally stationary support, and a seat bottom with a rearward portion thereof positioned to contact at least a portion of a buttock area of an adult user, and a forward portion thereof positioned to contact at least a portion of a thigh area of an adult user, the improvement of a controlled deflection front lip arrangement, comprising:

means for connecting the rearward portion of the seat bottom with said support;

a spring mechanism connecting the forward portion of the seat bottom with said support, and permitting selective, upward and downward movement therebetween which defects said spring mechanism;

a stop positively limiting the upward movement of the forward portion of said seat at a fully upward position;

means for preloading said spring mechanism to normally bias the forward portion of said seat into the fully upward position, and provide initial support thereto, whereby body movement of a seated user overcomes the initial support provided by said spring mechanism preloading means, and deflects the forward portion of said seat bottom downwardly of the rearward portion of said seat bottom to alleviate undesirable pressure at the thigh area of the user.

21. A seat as set forth in claim 20, wherein;

said spring includes means for permitting left-hand and right-hand portions of said seat bottom to deflect upwardly and downwardly independently of each other.

22. A chair comprising:

a base;

a seat having a rearward portion thereof positioned to contact at least a portion of a buttock area of an adult user, and a forward portion thereof positioned to contact at least a portion of a thigh area of an adult user;

means for connecting the rearward portion of said seat with said base;

a spring mechanism connecting the forward portion of said seat with said base, and permitting selective, upward and downward movement therebetween which deflects said spring, whereby body movement of a seated user deflects the forward portion of said seat upwardly and downwardly independently of the rearward portion of said seat to alleviate undesirable pressure at the thigh area of the user; said spring mechanism including:

a front bracket operatively connected with and supporting the forward portion of said seat, and including first and second L-shaped brackets depending from a lower surface thereof;

a leaf spring oriented transversely across the forward portion of said seat, and having a center portion thereof operably connected with the forward portion of said seat, and opposite end portions extending laterally outwardly and downwardly from the center portion of said leaf spring;

first and second guides positioned on the opposite end portions of said leaf spring; said first and second guides operably connecting the end portions of said leaf spring with said base, and being positioned in said first and second brackets to retain said leaf spring in an arcuate, preloaded configuration to provide initial support, whereby downward movement of the forward portion of said seat tends to flatten the arcuate configuration of said leaf spring, thereby generating a biasing force which resists further downward movement of the forward portion of said seat; and a stop positioned to positively limit the upward and downward movement of the forward portion of said seat.

23. A seat as set forth in claim 21, wherein:

said spring mechanism comprises a leaf spring having a center portion thereof operably connected with one of said seat bottom and said support, and opposite end portions thereof operably connected with the other of said seat bottom and said support.

24. A seat as set forth in claim 23, wherein:

said leaf spring is oriented transversely across the forward portion of said seat bottom.

25. A seat as set forth in claim 24, including:

first and second guides connected with the opposite end portions of said leaf spring;

first and second brackets connected with said seat bottom and shaped to receive said first and second guides therein, and permit upward and downward movement therebetween; said brackets being positioned to retain said leaf spring in an arcuate, preloaded configuration, and permitting the opposite ends of said leaf spring to flex independently to define at least a portion of said means for permitting the left-hand and right-hand portions of said seat bottom to move independently of each other.

26. A seat as set forth in claim 25, including:

means for connecting said first and second guides with said support; and means for positioning the center portion of said leaf spring to move with the forward portion of said seat bottom, whereby downward movement of the forward portion of said seat tends to flatten the arcuate configuration of said leaf spring, thereby generating a biasing force which resists further downward movement of the forward portion of said seat bottom.

27. A seat as set forth in claim 26, wherein:

said leaf spring is positioned in a downwardly opening orientation.

28. A seat as set forth in claim 20, wherein:

said seat has a one-piece, integrally formed, flexible construction which permits the forward portion of said seat bottom to deflect with respect to the rearward portion of said seat bottom.

29. A seat as set forth in claim 20, including:

a back operably connected with said seat bottom, and positioned to selectively contact and support a back area of an adult user.

30. A seat as set forth in claim 29, including:

means for supporting said back on said support, and permitting said back to tilt rearwardly.

* * * * *

UNITED STATES PATENT AND TRADEMARK OFFICE

CERTIFICATE OF CORRECTION

PATENT NO. : 5,050,931

DATED : September 24, 1991

INVENTOR(S) : Glenn A. Knoblock

It is certified that error appears in the above-indentified patent and that said Letters Patent is hereby corrected as shown below:

Column 2, line 12;
after "the" insert --present--.
Column 2, line 18;
after "portion" insert --of the--.
Column 2, line 28;
after "in" insert --the upright--.
Column 2, line 36;
after "rearwardly" insert --tilted--.
Column 2, line 40;
"a" should be --along--.
Column 3, line 46;
after "front" delete six spaces.
Column 3, line 66;
after "therefor" insert --.--.
Column 5, line 59;
after "3" insert --37--

Column 9, line 18;
"ar" should be --are--.
Column 10, line 17;
"o" should be --or--.
Column 12, line 9;
"a" should be --an--.
Column 14, line 39;
after "3" insert --37--
Column 14, line 45;
after "back" insert --5--.

UNITED STATES PATENT AND TRADEMARK OFFICE

CERTIFICATE OF CORRECTION

PATENT NO. : 5,050,931

DATED : September 24, 1991

INVENTOR(S) : Glenn A. Knoblock

It is certified that error appears in the above-indentified patent and that said Letters Patent is hereby corrected as shown below:

Column 16, line 63, claim 13, line 1;
"where" should be --wherein--.

Signed and Sealed this

Eighteenth Day of January, 1994

*Attest:*

Bruce Lehman

BRUCE LEHMAN

*Attesting Officer*

*Commissioner of Patents and Trademarks*